US012617568B2

(12) United States Patent
Saffar et al.

(10) Patent No.: US 12,617,568 B2
(45) Date of Patent: May 5, 2026

(54) PAPER-BASED MULTILAYER PACKAGING MATERIALS AND METHODS

(71) Applicant: PROAMPAC HOLDINGS INC., Cincinnati, OH (US)

(72) Inventors: Amir Saffar, Laval (CA); Raymond J. Recchia, Cincinnati, OH (US); Terry J. Leis, Huntington, MA (US); Seyed Hesamoddin Tabatabaei, Mason, OH (US)

(73) Assignee: ProAmpac Holdings Inc., Cincinnati, OH (US)

( * ) Notice: Subject to any disclaimer, the term of this patent is extended or adjusted under 35 U.S.C. 154(b) by 349 days.

(21) Appl. No.: 18/197,048

(22) Filed: May 13, 2023

(65) Prior Publication Data

US 2023/0365283 A1 Nov. 16, 2023

Related U.S. Application Data

(60) Provisional application No. 63/408,912, filed on Sep. 22, 2022, provisional application No. 63/341,591, filed on May 13, 2022.

(51) Int. Cl.
*B65B 11/06* (2006.01)
*B65D 75/26* (2006.01)

(52) U.S. Cl.
CPC ..... *B65B 11/06* (2013.01); *B65D 75/26* (2013.01)

(58) Field of Classification Search
CPC ..... B65B 11/06; B65D 75/26; B32B 2307/31; B32B 2307/7244; B32B 2307/7246; B32B 2439/46; B32B 2439/70; B32B 7/12; B32B 27/10; B32B 27/16; B32B 27/306; B32B 27/308; B32B 27/08; B32B 27/32
See application file for complete search history.

(56) References Cited

U.S. PATENT DOCUMENTS 8,158,226 B2 4/2012 Oshita et al.
8,409,679 B2 4/2013 Bentmar et al.
(Continued)

FOREIGN PATENT DOCUMENTS

CN 111114075 A 5/2020
JP 6264092 B2 1/2018
(Continued)

OTHER PUBLICATIONS

Anukiruthika et al., "Multilayer packaging: Advances in preparation techniques and emerging food applications," Comprehensive Reviews in Food Science and Food Safety, 2020, 19, 1156-1186 (Apr. 20, 2020).

(Continued)

*Primary Examiner* — Michael C Miggins
(74) *Attorney, Agent, or Firm* — McLane Middleton, Professional Association

(57) ABSTRACT

A multilayer packaging material includes a substrate formed of a cellulosic fiber-based material. The substrate has a first major surface and a second major surface opposite the first major surface. An oxygen barrier layer is formed of a PVOH material attached to the substrate, wherein the oxygen barrier layer is an innermost layer of the multilayer packaging material and further wherein the oxygen barrier layer is heat sealable. At least one moisture barrier layer is attached to the substrate, the moisture barrier layer selected from an inner moisture barrier layer disposed intermediate the substrate and the oxygen barrier layer and an outer moisture barrier layer disposed on the second major surface of the substrate. In further aspects, a packaging article, a method for making a multilayer packaging material, and a method for packaging a product are provided.

24 Claims, 17 Drawing Sheets

(56) References Cited

U.S. PATENT DOCUMENTS

| | | | |
|---|---|---|---|
| 9,662,863 | B2 | 5/2017 | Lorenzetti et al. |
| 11,040,520 | B2 | 6/2021 | Oveby |
| 2009/0061061 | A1 | 3/2009 | Beckwith et al. |
| 2009/0286090 | A1 | 11/2009 | Ting et al. |
| 2010/0032337 | A1 | 2/2010 | Cotter |
| 2011/0132975 | A1 | 6/2011 | Toft et al. |
| 2012/0100320 | A1 | 4/2012 | Toft et al. |
| 2013/0142975 | A1 | 6/2013 | Wallace |
| 2017/0246836 | A1 | 8/2017 | Giusti et al. |
| 2018/0311940 | A1 | 11/2018 | Toft et al. |
| 2019/0016528 | A1 | 1/2019 | Kuhl et al. |
| 2021/0107263 | A1 | 4/2021 | Bartolucci et al. |
| 2021/0339519 | A1 | 11/2021 | Romeiro |
| 2022/0024191 | A1 | 1/2022 | Jones et al. |

FOREIGN PATENT DOCUMENTS

| | | | |
|---|---|---|---|
| WO | 2021065878 | A1 | 4/2021 |
| WO | 2021065888 | A1 | 4/2021 |
| WO | 2021020558 | A1 | 2/2023 |

OTHER PUBLICATIONS

Bauer et al., "Recyclability and redesign challenges in multilayer flexible food packaging—A review," 2021, 10, 2702 (Nov. 5, 2021).

Tyagi et al., Advances in barrier coatings and film technologies for achieving sustainable packaging of food products—A review, Trends in Food Science & Technology, 115, 461-465 (Jun. 25, 2021).

Van Nguyen et al., "Polyvinyl alcohol/cellulose nanocrystals/alkyl ketene dimer nanocomposite as a novel biodegradable food packing material," International Journal of Biological Macromolecules, 207, 31-39 (Mar. 3, 2022).

Bayer, Biopolymers in multilayer films for long-lasting protective food packaging: A review, Sustainable Food Packaging Technology, First Edition, 395-426 (2021).

Mathew, "Nanostructure-based multilayer food packaging films," Nanotechnology-Enhanced Food Packaging, First Edition, 265-283 (2022).

English Machine Translation of JP6264092B2.

English Machine Translation of CN111114075A.

English Machine Translation of WO2021/065888A1.

English Machine Translation of WO2021/065878A1.

English Machine Translation of WO2021/020558A1.

International Search Report and Written Opinion received in PCT/US2023/022165 dated Jul. 31, 2023.

PAPER-BASED MULTILAYER PACKAGING MATERIALS AND METHODS

RELATED APPLICATION

This application claims the priority benefit of U.S. provisional application Ser. No. 63/341,591 filed May 13, 2022 and U.S. provisional application Ser. No. 63/408,912 filed Sep. 22, 2022. Each of the aforementioned applications is incorporated herein by reference in its entirety.

BACKGROUND

Flexible packaging, particularly for food, is subject to many demands. The packaging needs to be workable in such a way that the packaging material may be quickly placed around the item to be packaged using machinery. The packaging material must also be of such a quality that it adequately stores the product before the packaging is opened. In the case of oxygen-sensitive products, such as food products, pharmaceutical products, and the like, this typically means that the packaging materials provide an oxygen barrier to maintain freshness.

Polyvinyl alcohol (PVOH) is an extrudable synthetic polymer that has good oxygen barrier properties. PVOH is water soluble and biodegradable under both aerobic and anaerobic conditions. However, when exposed to higher relative humidity levels, e.g., about 20% or higher, the oxygen barrier properties of PVOH degrade. To avoid this degradation, the PVOH is typically used as an inner layer in a multilayer structure intermediate interior and exterior layers comprising polymer layers that that provide good resistance to moisture penetration. As used herein, the term "inner layer" refers to a layer within a multilayer packaging structure herein is that is not exposed to handling and the environment. As used herein, the term "outer layer" refers to a layer which comes in immediate contact with the outside environment or atmosphere, i.e., the innermost and outermost layers of a packaging structure.

There has also been a challenge in using cellulosic fiber-based products, such as paper or paperboard due to the need to provide product freshness over a period of time. In the case of current fiber-based products, the barrier to oxygen and moisture has most often been via a one or more plastic membrane layers. However, plastic in combination with cellulosic fiber-based structures has commonly resulted in packaging that is not recyclable in paper recycle streams.

The present disclosure contemplates new and improved packaging materials, packaging articles, and methods which overcome the above-referenced problems and others.

SUMMARY

In one aspect, a multilayer packaging material comprises a substrate formed of a cellulosic fiber-based material, the substrate having a first major surface and a second major surface opposite the first major surface. An oxygen barrier layer is formed of a PVOH material attached to the first major surface of the substrate, wherein the oxygen barrier layer is an innermost layer of the multilayer packaging material and further wherein the oxygen barrier layer is heat sealable. At least one moisture barrier layer is attached to the substrate, wherein the moisture barrier layer selected from the group consisting of (a) an inner moisture barrier layer attached to the first major surface of the substrate and disposed intermediate the substrate and the oxygen barrier layer; and (b) an outer moisture barrier layer attached to the second major surface of the substrate.

In a more limited aspect, the at least one moisture barrier layer comprises one or both of: (a) the inner moisture barrier layer disposed intermediate the substrate and the oxygen barrier layer, wherein the inner moisture barrier layer comprises a polyolefin-based polymer resin, a functionalized polyolefin-based polymer resin, and a dried polymer dispersion; and (b) the outer moisture barrier layer disposed on the second major surface of the substrate, wherein the inner moisture barrier layer comprises a polyolefin-based polymer resin, a functionalized polyolefin-based polymer resin, and a dried polymer dispersion.

In another more limited aspect, the at least one moisture barrier layer comprises one or both of: (a) the inner moisture barrier layer disposed intermediate the substrate and the oxygen barrier layer, wherein the inner moisture barrier layer comprises a polyolefin-based polymer resin or a functionalized polyolefin-based polymer resin; and (b) the outer moisture barrier layer disposed on the second major surface of the substrate, wherein the inner moisture barrier layer comprises a dried polymer dispersion.

In another more limited aspect, the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

In another more limited aspect, the multilayer packaging material comprises the inner moisture barrier layer and further comprises a tie resin layer between the inner moisture barrier and the oxygen barrier layer.

In another more limited aspect, the oxygen barrier layer, tie resin layer, and inner moisture barrier layer and are layers of a three-layer coextrusion.

In another more limited aspect, the oxygen barrier layer and tie resin layer are layers of a two-layer coextrusion.

In another more limited aspect, the tie resin layer and inner moisture barrier layer are layers of a two-layer coextrusion.

In another more limited aspect, the oxygen barrier layer and inner moisture barrier layer are layers of a two-layer coextrusion.

In another more limited aspect, the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

In another more limited aspect, the oxygen barrier layer defines a product-contacting surface of the multilayer packaging material and wherein the PVOH material is present in an amount sufficient to render the product-contacting surface of the multilayer packaging material grease resistant.

In another more limited aspect, the inner moisture barrier layer is directly attached to the first major surface of the substrate.

In another more limited aspect, the multilayer packaging material has an oxygen transmission rate (OTR) between about 0.001 cc/100 in2/day and about 1.0 cc/100 in2/day measured at 0% relative humidity and 23° C.

In another more limited aspect, the multilayer packaging material has a water vapor transmission rate (WVTR) between about 0.001 cc/100 in2/day to about 2 cc/100 in2/day measured at 23° C. and 85% relative humidity.

In another more limited aspect, a primer layer is disposed between the inner moisture barrier layer and the oxygen barrier layer.

In another more limited aspect, a tie resin layer and a primer layer are disposed between the inner moisture barrier layer and the oxygen barrier layer.

In another more limited aspect, a tie resin layer is directly adjacent to the inner moisture barrier layer and a primer layer is disposed directly adjacent to the oxygen barrier layer.

In another more limited aspect, the inner moisture barrier layer comprises one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof.

In another more limited aspect, the substrate is selected from the group consisting of a paper substrate and a paperboard substrate.

In another more limited aspect, the substrate has a basis weight in the range of from 20 pounds per 3,000 square feet to 120 pounds per 3,000 square feet.

In another more limited aspect, a printed ink layer is disposed on the second major surface of the substrate.

In another more limited aspect, the oxygen barrier layer is food safe.

In another more limited aspect, the multilayer packaging material is recyclable in a paper recycling process.

In another more limited aspect, the first major surface of the substrate is a treated surface configured to promote adhesion between the inner moisture barrier layer and the substrate.

In another more limited aspect, the treated surface is selected from the group consisting of a flame treated surface, a corona treated surface, a plasma treated surface, an ozone treated surface, and a liquid primer treated surface.

In a further aspect, a packaging article formed of the multilayer packaging material herein is provided.

In a more limited aspect, the packaging article is a bag or a pouch and the oxygen barrier layer is hermetically heat sealed to itself.

In a further aspect, a method of making a multilayer packaging material comprises providing a substrate formed of a cellulosic fiber-based material, the substrate having a first major surface and a second major surface opposite the first major surface. An oxygen barrier layer formed of a PVOH material is attached to the first major surface of the substrate, wherein the oxygen barrier layer forms an innermost layer of the multilayer packaging material, and further wherein the oxygen barrier layer is heat sealable. At least one moisture barrier layer is attached to the substrate, the moisture barrier layer selected from the group consisting of (a) an inner moisture barrier layer disposed intermediate the substrate and the oxygen barrier layer; and (b) an outer moisture barrier layer disposed on the second major surface of the substrate.

In a more limited aspect, wherein the inner moisture barrier layer is selected from the group consisting of a polyolefin-based polymer resin, a functionalized polyolefin-based polymer resin, and a dried polymer dispersion and wherein the outer moisture barrier layer is selected from the group consisting of a polyolefin-based polymer resin, a functionalized polyolefin-based polymer resin, and a dried polymer dispersion.

In another more limited aspect, the inner moisture barrier layer is selected from the group consisting of a polyolefin-based polymer resin and a functionalized polyolefin-based polymer resin, and wherein the outer moisture barrier layer is a dried polymer dispersion.

In another more limited aspect, the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

In another more limited aspect, one or both of a tie resin layer and a primer layer is provided between the inner moisture barrier and the oxygen barrier layer.

In another more limited aspect, the inner moisture barrier layer, a tie resin layer, and the oxygen barrier layer are coextruded as a three-layer coextrusion.

In another more limited aspect, the oxygen barrier layer and tie resin layer are coextruded as a two-layer coextrusion.

In another more limited aspect, the inner moisture barrier layer and tie resin layer are coextruded as a two-layer coextrusion.

In another more limited aspect, the oxygen barrier layer and inner moisture barrier layer are coextruded as a two-layer coextrusion.

In another more limited aspect, the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

In another more limited aspect, the oxygen barrier layer defines a product-contacting surface of the multilayer packaging material, wherein the PVOH material is present in an amount sufficient to render the product-contacting surface of the multilayer packaging material grease resistant.

In another more limited aspect, the inner moisture barrier layer is directly attached to the first major surface of the substrate.

In another more limited aspect, the multilayer packaging material has an oxygen transmission rate (OTR) between about 0.001 cc/100 in2/day and about 1.0 cc/100 in2/day measured at 0% relative humidity and 23° C.

In another more limited aspect, the multilayer packaging material has a water vapor transmission rate (WVTR) between about 0.001 cc/100 in2/day to about 2 cc/100 in2/day measured at 23° C. and 85% relative humidity.

In another more limited aspect, a tie resin layer is directly adjacent to the inner moisture barrier layer and a primer layer directly adjacent to the oxygen barrier layer.

In another more limited aspect, the inner moisture barrier layer comprises one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof.

In another more limited aspect, the substrate is selected from the group consisting of a paper substrate and a paperboard substrate.

In another more limited aspect, the substrate has a basis weight in the range of from 20 pounds per 3,000 square feet to 120 pounds per 3,000 square feet;

In another more limited aspect, a printed ink layer is provided on the second major surface of the substrate.

In another more limited aspect, the oxygen barrier layer is food safe.

In another more limited aspect, the multilayer packaging material is recyclable in a paper recycling process.

In another more limited aspect, the first major surface to promote adhesion between the inner moisture barrier layer and the substrate.

In another more limited aspect, the treatment is selected from the group consisting of a flame treating, corona treating, plasma treating, ozone treating, and liquid primer treating.

In a further aspect, a method of packaging a product comprises placing a multilayer packaging material around and in contact with the product, the multilayer packaging material comprising a substrate formed of a cellulosic fiber-based material, the substrate having a first major surface and a second major surface opposite the first major surface. An oxygen barrier layer formed of a PVOH material is attached to the first major surface of the substrate, wherein the oxygen barrier layer is an innermost layer of the multilayer packaging material and further wherein the oxygen barrier layer is heat sealable. At least one moisture barrier layer is attached to the substrate, the moisture barrier layer selected from the group consisting of: (a) an inner moisture barrier layer attached to the first major surface of the substrate and disposed intermediate the substrate and the oxygen barrier layer; and (b) an outer moisture barrier layer attached to the second major surface of the substrate. A first portion of the oxygen barrier layer is brought into opposing and contacting relation with a second portion of the oxygen barrier layer and the first portion of the oxygen barrier layer is heat sealed to the second portion of the oxygen barrier layer to hermetically seal the product within the multilayer packaging material.

In a more limited aspect, the product is a food product.

One advantage of the present development resides in the use of PVOH as both a sealant layer and an oxygen barrier layer. Avoiding the need for separate oxygen barrier and sealant layers allows for a reduction of amount of non-cellulosic fiber material in a paper-based packaging structure.

Another advantage of the present development is found in the solubility or dispersability of PVOH in water. This allows the PVOH to be removed during a recycling or repulping process. Since the quantity of synthetic polymer in a paper-based packaging structure must be below a threshold value (e.g., 20% by weight, 15% by weight, 10% by weight, etc.) in order to be recycled in current paper recycling streams, the ability to wash the PVOH component aids in the design of packaging structures for paper recycle streams.

Another advantage of the present development resides in its use of an unfunctionalized or functionalized polyolefin as a moisture barrier layer. By disposing the moisture barrier layer outwardly with respect to the PVOH layer, the water soluble PVOH layer is protected from water and humidity. The moisture barrier layer also improves the flexibility of the packaging material herein and provides resistance to flex cracking, protects the barrier layer from damage, and provides increased drop resistance.

The foregoing and still other advantages of the invention will become apparent to those of ordinary skill in the art upon reading and understanding the following description. In the description, reference is made to the accompanying drawings which form a part hereof and in which there are shown by way of illustration preferred embodiments of the invention. These embodiments do not represent the full scope of the invention. Rather, the claims should be looked to in order to judge the full scope of the invention.

BRIEF DESCRIPTION OF THE DRAWINGS

The invention may take form in various components and arrangements of components, and in various steps and arrangements of steps. The drawings, which are not necessarily to scale, are only for purposes of illustrating preferred embodiments and are not to be construed as limiting the invention.

DETAILED DESCRIPTION OF EMBODIMENTS

Figure 1B:
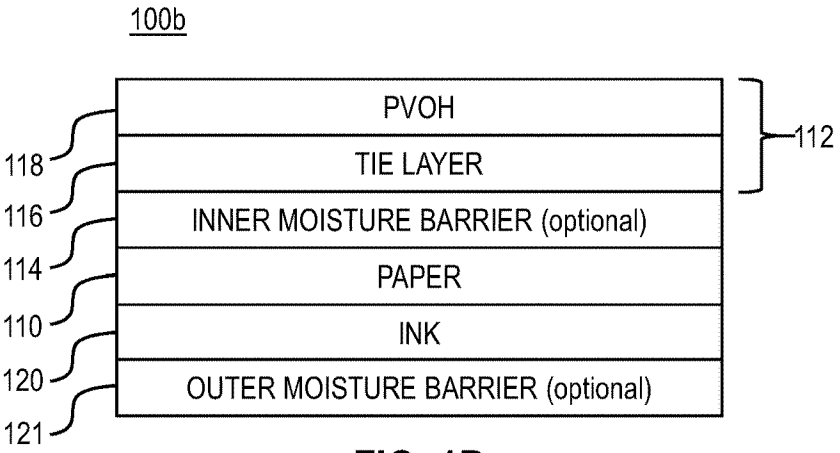
FIG. 1B illustrates the layer structure of a variation of the first exemplary embodiment appearing in FIG. 1A, except that the inner moisture barrier is a separately applied layer.

Disclosed below are structures for paper-based packaging containing PVOH having good oxygen barrier and moisture barrier properties.

The terms "a" or "an," as used herein, are defined as one or more than one. The term "another," as used herein, is defined as at least a second or more. The terms "including" and/or "having," as used herein, are defined as "comprising" (i.e., open transition). Unless specifically stated otherwise, the terms "attached," "coupled," "operatively coupled," "joined," and the like are defined as indirectly or directly connected.

As used herein, "recyclable" may refer to a paper-based product that is eligible for acceptance into paper recycling programs, including curbside collection programs and recycling programs that use drop-off locations, including products that comply with one or more promulgated standards or guidelines for recyclability, and including materials that are sufficiently free of plastic materials, such as polyethylene, nylon, polypropylene, polyester, and others which would impede recyclability.

As used herein, "repulpable" may refer to a product that can be reused or remade into paper (e.g., at a paper mill), including products that comply with one or more promulgated standards or guidelines for repulpability, and including materials that are sufficiently free of plastic materials, such as polyethylene, nylon, polypropylene, polyester, and others which would impede repulpability.

As used herein, the terms "grease resistant" or "grease resistance" refers to the character of the PVOH barrier layer in blocking or impeding the absorption or transmission of grease or oil in any significant quantity.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Accordingly, unless indicated to the contrary, the numerical parameters set forth in the present specification and attached claims are approximations that can vary depending upon the desired properties sought to be obtained by the presently disclosed subject matter.

As used herein, the term "about," when referring to a value can encompass variations of, in some embodiments ±20%, in some embodiments ±10%, in some embodiments ±5%, in some embodiments ±1%, in some embodiments ±0.5%, in some embodiments ±0.1%, and in some embodiments to ±0.01%, from the specified amount, as such variations are appropriate in the disclosed materials and methods.

As used herein, the term "extrusion" is used with reference to the process of forming continuous shapes by forcing a molten plastic material through a die, followed by cooling or chemical hardening. Immediately prior to extrusion through the die, the polymeric material is fed into a rotating screw, i.e., an extruder that forces the polymeric material through the die.

As used herein, the term "coextrusion" refers to the process of extruding two or more materials through a single die with two or more orifices arranged so that the extrudates merge and weld together into a laminar structure before chilling, i.e., quenching.

All compositional percentages used herein are presented on a "by weight" basis, unless specifically stated otherwise.

As used herein, a "–" is used to indicate layers that are coextruded with one another and a "/" is used to indicate layers that are separately attached to one another.

Figure 1A:
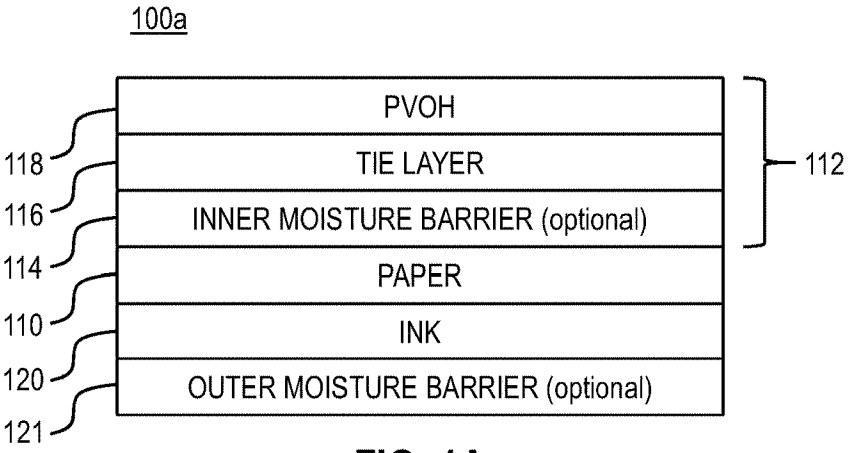
FIG. 1A illustrates the layer structure of a first exemplary embodiment of the packaging structures herein.

Now with reference to FIGS. 1A through 6, a number of packaging structures are illustrated including:

FIG. 1A: Paper/Moisture Barrier Resin-Tie Resin-PVOH

FIG. 1B: Paper/Moisture Barrier Coating/Tie Resin-PVOH

Figure 2:
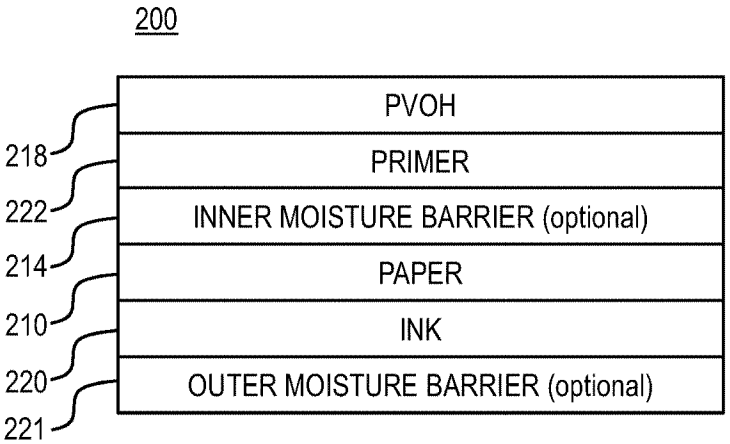
FIG. 2 illustrates the layer structure of a second exemplary embodiment of the packaging structures herein.

FIG. 2: Paper/Moisture Barrier Resin/Primer/PVOH

Figure 3B:
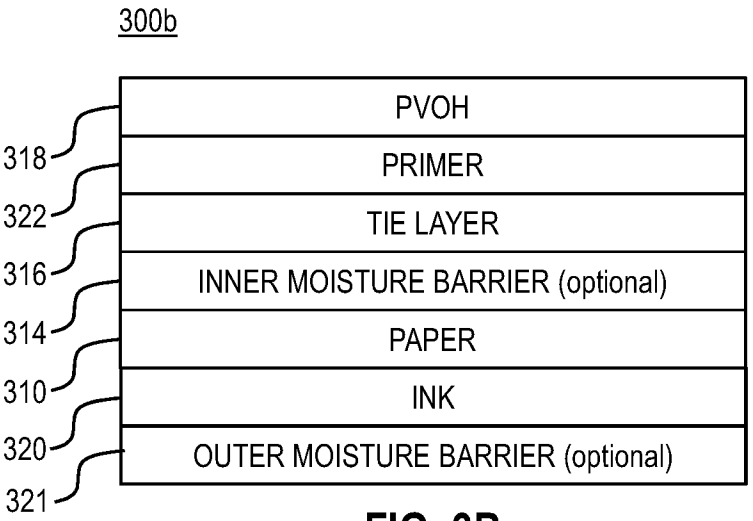
FIG. 3B illustrates the layer structure of a variation of the third exemplary embodiment appearing in FIG. 3A, except that the inner moisture barrier is a separately applied layer.
Figure 3A:
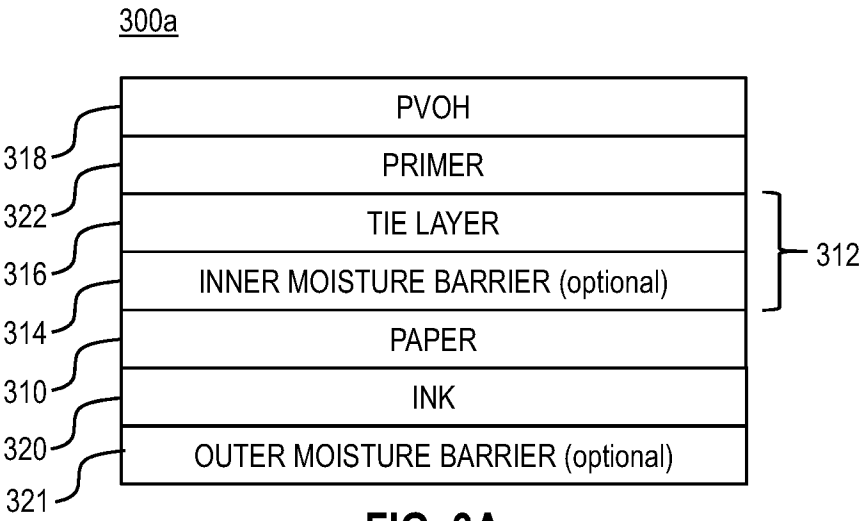
FIG. 3A illustrates the layer structure of a third exemplary embodiment of the packaging structures herein.

FIG. 3A: Paper/Moisture Barrier Resin-Tie Resin/Primer/PVOH

FIG. 3B: Paper/Moisture Barrier Coating/Tie Resin/Primer/PVOH

Figure 4:
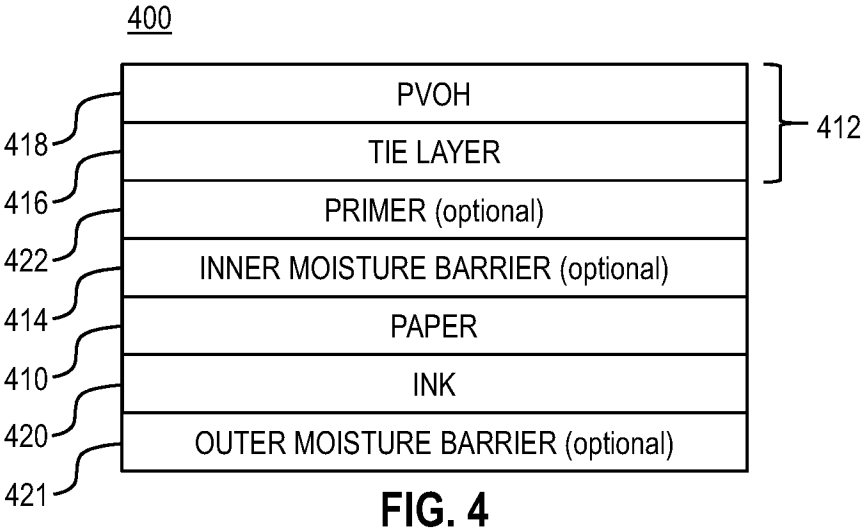
FIG. 4 illustrates the layer structure of a fourth exemplary embodiment of the packaging structures herein.

FIG. 4: Paper/Moisture Barrier Resin/Primer (optional)/Tie Resin-PVOH

Figure 5B:
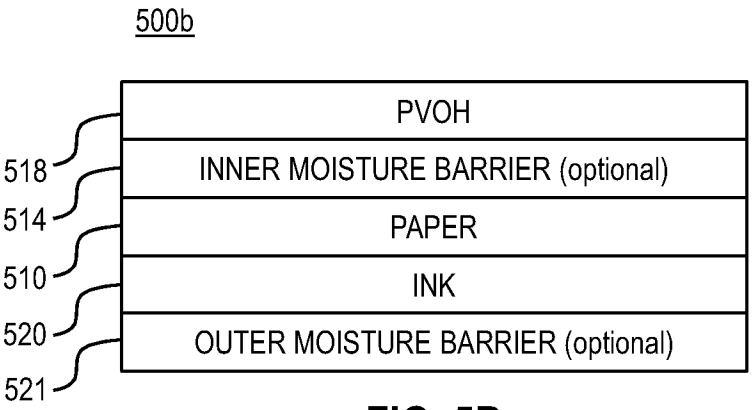
FIG. 5B illustrates the layer structure of a variation of the fifth exemplary embodiment appearing in FIG. 5A, except that the inner moisture barrier is a separately applied layer.
Figure 5A:
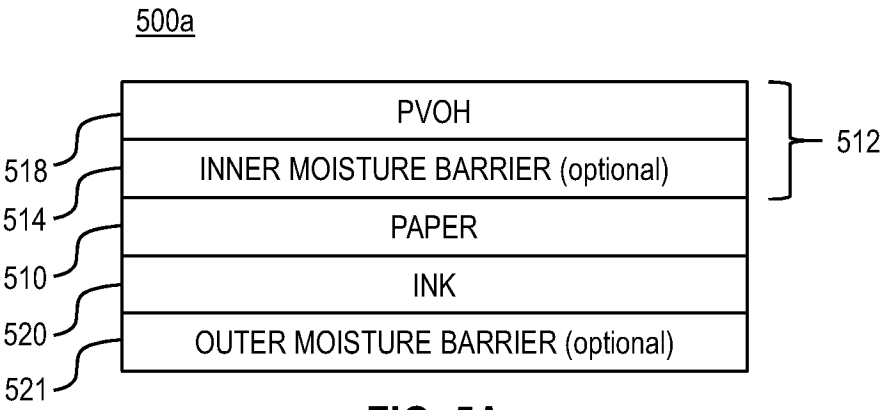
FIG. 5A illustrates the layer structure of a fifth exemplary embodiment of the packaging structures herein.

FIG. 5A: Paper/Moisture Barrier Resin-PVOH

FIG. 5B: Paper/Moisture Barrier Coating/PVOH

Figure 6:
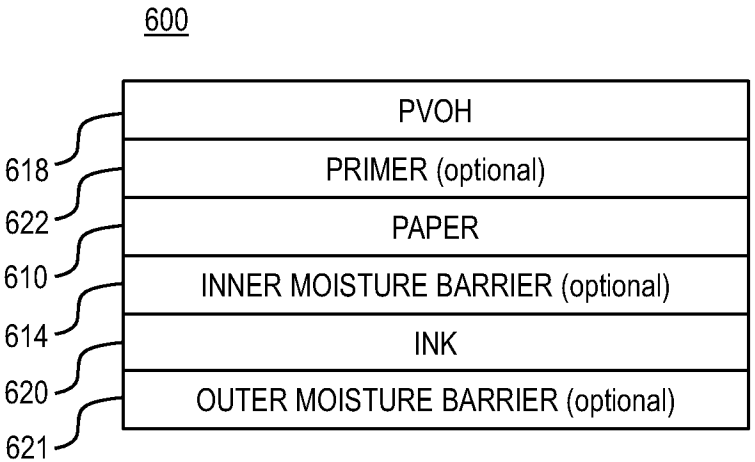
FIG. 6 illustrates the layer structure of a sixth exemplary embodiment of the packaging structures herein.

FIG. 6: Moisture Barrier Resin/Paper/Primer/PVOH

Moisture Barrier Resin-Tie Resin-PVOH refers to three discrete coextruded layers of a moisture barrier resin, tie resin, and PVOH. Tie Resin-PVOH refers to two discrete coextruded layers of a tie resin and PVOH. Moisture Barrier Resin-Tie Resin refers to two discrete coextruded layers of moisture barrier resin and tie resin. Moisture Barrier Resin-PVOH refers to two discrete coextruded layers of a moisture barrier resin and PVOH.

Tie resin is a type of resin designed to increase adhesion between the moisture barrier resin layer and the PVOH layer. Primer is a coating layer applied to increase adhesion between the moisture barrier resin layer and the PVOH layer.

With respect to the drawing figures, like reference numerals are used to describe like or analogous items in which the hundreds digit has been increased to correspond to the figure number (e.g., paper-based substrate 110 in FIG. 1A corresponds to paper-based substrate 210 in FIG. 2, and so forth). The description in reference to any given reference numeral herein is equally applicable to other reference numerals that differ only in the hundreds digit, unless specifically stated otherwise.

Referring now to FIG. 1A, a packaging structure 100*a* includes a paper substrate 110, at least one of an inner moisture barrier 114 and an outer moisture barrier 121, a tie layer 116, a PVOH layer 118, and an optional printed ink layer 120.

A paper substrate 110 which has a first major surface, which is outward facing, and a second major surface, which is inward facing, opposite the first major surface. A moisture barrier resin-tie resin-PVOH coextrusion 112 is disposed on the paper substrate 110 second major surface. The moisture barrier resin-tie resin-PVOH coextrusion 112 includes the inner moisture barrier 114 resin layer 114, which is disposed on the second major surface of the paper substrate 110. In the illustrated embodiment, the inner moisture barrier 114 is a coextruded resin layer. In embodiments, the inner moisture barrier layer 114 is directly attached to the substrate 110 second major surface. In embodiments, the inner moisture barrier layer 114 is a coated moisture barrier layer, e.g., an extrusion coated resin layer or other coating layer such as a dried polymer dispersion layer, as shown in FIG. 1B. In embodiments, if the outer moisture barrier layer 121 is present, the inner moisture barrier layer 114 can be omitted. In embodiments, if the inner moisture barrier layer 114 is present, the outer moisture barrier layer 121 can be omitted.

The inner moisture barrier resin-tie resin-PVOH coextrusion 112 further includes a PVOH layer 118 which defines the innermost layer of the packaging structure 100*a*. A tie layer 116 is disposed intermediate the inner moisture barrier 114 and the PVOH layer 118. The PVOH layer 118 forms a heat sealant layer which is heat sealable to form a seal, e.g., a hermetic seal, in a packaging article when the layer 118 is contacted with another exposed PVOH surface and subjected to heat and pressure to form a seal there between. Exemplary flexible packaging articles include pouches, bags, overwraps, and the like, and may be, for example, pinch bottom type pouches or bags, four-side seal bags, three-side seal bags (e.g., wherein the bottom seal is replaced with a fold), pillow bags (e.g., having a longitudinal fin seal), standup pouches, side gusset bags, quad seal bags, side weld bags, and others.

In embodiments, the PVOH layer 118 has a seal initiation temperature (SIT) of less than 140° C. at a sealing pressure of 40 psi and a dwell time of 0.5 seconds, and is preferably in the range of from about 70° C. to about 140° C. at a sealing pressure of 40 psi and a dwell time of 0.5 seconds. In embodiments, the seal initiation temperature (SIT) at the aforementioned sealing pressure and dwell time is 70° C., 75° C., 80° C., 85° C., 90° C., 95° C., or 100° C., 105° C., 110° C., 115° C., 120° C., 125° C., 130° C., 135° C., or 140° C.

In embodiments, the PVOH layer 118 has a kinetic coefficient of friction (COF or μk) in the range of from 0.15 to 0.5 (sliding velocity of 6 in/minute) (e.g., 0.25 (sliding velocity of 6 in/minute)) when the layer 118 is sliding over itself of or another like layer 118.

In embodiments, the packaging structure 100*a* provides a high degree of resistance to grease permeation in a recyclable, paper-based structure. The grease resistance of the present packaging structures utilizing PVOH as the sealant layer is greater than films using polyethylene as the sealant layer, particularly when the thickness of the polyethylene is sufficiently low to allow the structure need to meet paper recyclability standards. In embodiments, the packaging structure 100*a* may be used to form packaging containers for oil or grease containing materials, including without limitation food products and pet food products.

The paper substrate 110 first major surface constitutes the outer surface of the packaging structure 100*a*. It is contemplated that a printed ink layer 120 is optionally provided on the first major surface of the substrate layer 110 to provide text, pictorial, or other graphical indicia or representations to appear on the exterior of a packaging article or container formed of the packaging structure 100*a*. The printing ink layer 120 can be applied to the first major surface of the paper substrate 110 via any conventional printing method as would be understood by persons skilled in the art, including without limitation, using a rotogravure printing apparatus, flexographic printing apparatus, offset printing apparatus, digital printing apparatus, ink jet printing apparatus, or the like. In embodiments, the printing ink layer 120 is intended to additionally include varnishes or over lacquers applied to the ink layer 120 to protect the ink(s) from scuffing and rubbing off and/or to provide a desired matte or gloss effect.

In the embodiments illustrated herein, it is contemplated that the printed ink layer 120 is applied to the first major surface in a separate printing step and the printed substrate is stored on a roll 702 (see FIG. 7) for later use. In alternative embodiments, the printed ink layer 120 is applied in the same process line as the moisture barrier resin, tie resin (and/or primer), and PVOH coating layers. For example, any of the process lines appearing in FIGS. 7-12B may be modified by additionally incorporating a print zone comprising a printing apparatus.

It will also be recognized that in certain embodiments, the printed ink layer 120 may be omitted, e.g., where it is desired that that the packaging structure 100*a* lacks printed indicia on the first major surface. In still further embodiments, the printed ink layer 120 and an optional moisture resistant coating 121 are applied together in a single step using a printing apparatus.

In embodiments, an optional outer moisture barrier 121 may be provided over the printed ink layer 120. In embodiments, the outer moisture barrier 121 is formed of resin selected from a polyolefin-based resin or a functionalized polyolefin-based resin, e.g., an extrusion-coated polyolefin-based resin or an extrusion-coated functionalized polyolefin-based resin. In embodiments, the polyolefin-based polymer resins are formed of a polyethylene-based or polypropylene-based polymer material and may be a monomaterial or blend, such as polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), or blends thereof as well as coextrusions thereof. Additives such as colors can be used.

In certain embodiments, the outer moisture barrier 121 is formed of a polymer material which comprises a functionalized polyolefin. As used herein, the term functionalized polyolefin means polyolefins synthesized by direct copolymerization with an olefin and a functionalized monomer or by post-polymerization modification of a polyolefin, such as grafting, catalyzed functionalization, or the like. In embodiments, the functionalized polyolefin may be a commercially available functionalized polyolefin tie resin material. In embodiments, the functionalized polyolefin is selected from polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

In embodiments, the outer moisture barrier 121 is a dried polymer-dispersion, e.g., applied as a coating in the form of an aqueous or non-aqueous solvent-based polymer dispersion and then dried. Exemplary solvents include water, ethanol, and isopropanol. Exemplary polymers include polyacrylates, latex, waxes (e.g., animal waxes, vegetable waxes, mineral waxes, and petroleum waxes), polystryenes, and polyolefins (e.g., polyethylenes and polypropylenes). The aqueous or non-aqueous solvent-based polymer dispersion is applied by a suitable coating technique, such as roll coating, roll-to-roll coating, various types of gravure coating, flexographic coating, bar coating, doctor blade coating, comma coating, spraying, or brush coating. The solvent is removed using heat, vacuum, forced hot air, drying oven, and the like.

It is contemplated that the paper substrate 110 may be a paper or paperboard. In embodiments, the paper substrate 110 may be of a type having a machine glazed (MG) or a machine finished (MF) type finish, may be clay coated paper, may be bleached or unbleached, and may be of a Kraft, ground wood, recycled, or sulfite furnish type although different types of paper are also contemplated.

In embodiments, the paper substrate 110 has a basis weight in the range of 20 pounds per 3,000 square feet (20 lb/3 MSF) to 120 pounds per 3,000 square feet (120 lb/3 MSF), more preferably 30 pounds per 3,000 square feet (30 lb/3 MSF) to 100 pounds per 3,000 square feet (100 lb/3 MSF). In certain embodiments, the paper substrate 110 has a basis weight of 20, 25, 30, 35, 40, 45, 50, 55, 60, 65, 70, 75, 80, 85, 90, 95, 100, 105, 110, 115, 120, or 125 lb/3 MSF.

In preferred embodiments, the paper substrate 110 is a type of paper that is recyclable. In preferred embodiments, the paper substrate 110 is a type of paper that is repulpable.

In certain embodiments, the inner moisture barrier 114 is formed of a polyolefin-based polymer material, preferably a polyethylene-based or polypropylene-based polymer material. In embodiments, the moisture barrier layer 114 may be comprise a monomaterial or a blend. In certain embodiments, the moisture barrier layer 114 is formed of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), or blends thereof as well as coextrusions thereof. Additives such as colors can be used.

In certain embodiments, the inner moisture barrier 114 is formed of a polymer material which comprises a functionalized polyolefin. As used herein, the term functionalized polyolefin means polyolefins synthesized by direct copolymerization with an olefin and a functionalized monomer or by post-polymerization modification of a polyolefin, such as grafting, catalyzed functionalization, or the like. In embodiments, the functionalized polyolefin may be a commercially available functionalized polyolefin tie resin material. In embodiments, the functionalized polyolefin is selected from polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

In certain embodiments, the inner moisture barrier 114 is a dried polymer-dispersion, e.g., applied as a coating in the form of an aqueous or non-aqueous solvent-based polymer dispersion and then dried. Exemplary solvents include water, ethanol, and isopropanol. Exemplary polymers include polyacrylates, latex, waxes (e.g., animal waxes, vegetable waxes, mineral waxes, and petroleum waxes), polystryenes, and polyolefins (e.g., polyethylenes and polypropylenes). The aqueous or non-aqueous solvent-based polymer dispersion is applied by a suitable coating technique, such as roll coating, roll-to-roll coating, various types of gravure coating, flexographic coating, bar coating, doctor blade coating, comma coating, spraying, or brush coating. The solvent is removed using heat, vacuum, forced hot air, drying oven, and the like In the illustrated embodiment 100*a*, the inner moisture barrier 114 is depicted as a single layer within the three-layer coextrusion 112. In alternative embodiments, the inner moisture barrier 114 may comprise two or more layers, for example, polyethylene, polypropylene, functionalized polyolefin, or any combinations thereof. For example, in embodiments, wherein the inner moisture barrier 114 comprises multiple layers, a single moisture barrier resin may be used, or alternatively, multiple resins may be used, and an extrusion machine capable of extruding more than three layers may be utilized.

In embodiments, to ensure good adhesion, the paper substrate 110 second major surface may be subjected to flame treatment, corona treatment, plasma treatment, ozone treatment, or other such priming to ready the surface for attachment.

Tie resins may also be used to create chemical bonding between the PVOH layer and the moisture barrier layer. In embodiments, such resins are applied in coextrusion, to create chemical bonding between two layers of molten materials, e.g., a molten moisture barrier layer and a molten PVOH layer. These types of resins may be used for making the co-extruded moisture barrier resin-tie resin-PVOH coextrusion 112 (see FIGS. 1 and 7), the moisture barrier resin-tie resin coextrusion 312 (see FIGS. 3, 9A, 9B), or the tie resin-PVOH coextrusion 412 (see FIGS. 4, 10A, and 10C). In certain embodiments, the tie resin is selected from polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

In certain embodiments, the composition of the packaging structures herein is such that total weight of the polymer materials and other nonfibrous components minus the weight of the PVOH layer does not exceed 20% by weight of the total weight of the packaging structure minus the weight of the PVOH layer. In certain embodiments, the composition of the packaging structures herein is such that total weight of the polymer materials and other nonfibrous components minus the weight of the PVOH layer does not exceed 15% by weight of the total weight of the packaging structure minus the weight of the PVOH layer. In certain embodiments, the composition of the packaging structures herein is such that total weight of the polymer materials and other nonfibrous components minus the weight of the PVOH layer does not exceed 10% by weight of the total weight of the packaging structure minus the weight of the PVOH layer. In certain embodiments, the composition of the packaging structures herein is such that total weight of the polymer materials and other nonfibrous components minus the weight of the PVOH layer does not exceed a maximum amount of plastics or non-paper components in accordance with an established standard or guideline for paper recyclability and/or repulpability.

In certain embodiments, the composition of the packaging structures herein is such that total weight of the polymer materials minus the weight of the PVOH layer does not exceed 20% by weight of the total weight of the packaging structure minus the weight of the PVOH layer. In certain embodiments, the composition of the packaging structures herein is such that total weight of the polymer materials minus the weight of the PVOH layer does not exceed 15% by weight of the total weight of the packaging structure minus the weight of the PVOH layer. In certain embodiments, the composition of the packaging structures herein is such that total weight of the polymer materials minus the weight of the PVOH layer does not exceed 10% by weight of the total weight of the packaging structure minus the weight of the PVOH layer. In certain embodiments, the composition of the packaging structures herein is such that total weight of the polymer materials minus the weight of the PVOH layer does not exceed a maximum amount of plastics or non-paper components in accordance with an established standard or guideline for paper recyclability and/or repulpability.

In certain embodiments, the composition of the layers is such that the inner moisture barrier 114, tie layer 116, and outer moisture barrier 121 together do not exceed 20% by weight of the total weight of the structure 100*a* minus the weight of the PVOH layer 118. In certain embodiments, the composition of the layers is such that the inner moisture barrier 114, tie layer 116, and outer moisture barrier 121 together do not exceed 15% by weight of the total weight of the structure 100*a* minus the weight of the PVOH layer 118. In certain embodiments, the composition of the layers is such that the inner moisture barrier 114, tie layer 116, and outer moisture barrier 121 together do not exceed 10% by weight of the total weight of the structure 100*a* minus the weight of the PVOH layer 118. In certain embodiments, the composition of the layers is such that the inner moisture barrier 114, tie layer 116, and outer moisture barrier 121 together do not exceed a maximum amount of plastics or non-paper components in accordance with an established standard or guideline for paper recyclability and/or repulpability.

In certain embodiments, the PVOH layer 118 has a thickness in the range of about 0.25 mil to about 5 mil. In certain embodiments, the PVOH layer 118 has a thickness in the range of about 0.3 mil to about 1 mil. In certain embodiments, the PVOH layer 118 has a thickness of about 0.25 mil, 0.5 mil, 0.75 mil, 1.0 mil, 1.25 mil, 1.5 mil, 1.75 mil, 2.0 mil, 3.25 mil, 3.5 mil, 3.75 mil, 4.0 mil, 4.25 mil, 4.5 mil, 5.75 mil, or 5.0 mil.

In certain embodiments, the PVOH barrier layer 118 is present in the structure 100*a* in the amount of 5% to 40% by weight based on the total weight of the packaging structure 100*a*. The exact percentages of the constituent components may be varied depending on a number of factors, including the packaging application as well as the temperatures, times, and pressures used to form the heat seal and the quality of the seal desired.

In embodiments, the PVOH layer is formed of a food-safe PVOH material. The term "food safe" means compositions considered safe for food contact and that will not transfer noxious or toxic substances into the food being held by the packaging, including without limitation materials regarded as "food grade" or "food safe" by the relevant regulatory authorities or organizations.

In certain embodiments, the packaging structure 100*a* has an oxygen transmission rate (OTR) in the range of 0.001 cc/100 $in^2$/day to 1.0 cc/100 $in^2$/day at 23° C. and 0% relative humidity. In certain embodiments, the packaging structure 100*a* has an OTR in the range of 0.03 cc/100 $in^2$/day to 0.05 cc/100 $in^2$/day at 23° C. and 0% relative humidity. In certain embodiments, the packaging structure 100*a* has an OTR of about 0.1 cc/100 $in^2$/day at 23° C. and 85% relative humidity.

In certain embodiments, the packaging structure 100*a* has a water vapor transmission rate (WVTR) in the range of 0.001 cc/100 $in^2$/day to 2.0 cc/100 $in^2$/day at 23° C. and 85% relative humidity.

In certain embodiments, the structure 100*a* includes both the inner moisture barrier 114 and the outer moisture barrier 121. In certain embodiments, the structure 100*a* includes the inner moisture barrier 114 and excludes the outer moisture barrier 121. In certain embodiments, the structure 100*a* excludes the inner moisture barrier 114 and includes the outer moisture barrier 121.

Referring now to FIG. 1B, there is shown an alternative embodiment structure 100*b*. The above description of the structure 100*a* is equally applicable to the embodiment 100*b* except that the PVOH layer 118 and tie layer 116 form a coextruded layer 112 and the inner moisture barrier 114 is a separately applied layer. In certain embodiments, the structure 100*b* includes both the inner moisture barrier 114 and the outer moisture barrier 121. In certain embodiments, the structure 100*b* includes the inner moisture barrier 114 and excludes the outer moisture barrier 121. In certain embodiments, the structure 100*b* excludes the inner moisture barrier 114 and includes the outer moisture barrier 121.

Turning now to FIG. 2, a packaging structure 200 is illustrated which comprises a paper substrate 210, at least one of an inner moisture barrier 214 and an outer moisture barrier 221, a primer layer 222, a PVOH layer 218, and an optional printed ink layer 220. The structure 200 is similar to the structure 100*a* appearing in FIG. 1A and described above, except that the moisture barrier resin-tie resin-PVOH coextrusion 112 appearing in FIG. 1A has been replaced by separate inner moisture barrier resin, primer, and PVOH layers 214, 222, and 218, respectively. Otherwise, the paper substrate 210, inner moisture barrier 214, PVOH layer 218, ink layer 220, and outer moisture barrier 221 are as described above. The tie layer 116 appearing in FIG. 1A has been replaced with a primer coating layer 222 disposed between the inner moisture barrier 214 and the PVOH layer 218. This configuration eliminates the need for a coextruder. In embodiments, the inner moisture barrier layer 214 is a coated moisture barrier layer, e.g., an extrusion coated resin layer or other coating layer such as a dried polymer dispersion layer as described above. In embodiments, if the outer moisture barrier layer 221 is present, the inner moisture barrier layer 214 can be omitted. In embodiments, if the inner moisture barrier layer 214 is present, the outer moisture barrier layer 221 can be omitted.

In certain embodiments, the composition of the layers is such that the inner moisture barrier 214 and outer moisture barrier 221 together do not exceed 20% by weight of the total weight of the structure 200 minus the weight of the PVOH layer 218. In certain embodiments, the composition of the layers is such that the inner moisture barrier 214 and outer moisture barrier 221 together do not exceed 15% by weight of the total weight of the structure 200 minus the weight of the PVOH layer 218. In certain embodiments, the composition of the layers is such that the inner moisture barrier 214 and outer moisture barrier 221 together do not exceed 10% by weight of the total weight of the structure 200 minus the weight of the PVOH layer 218. In certain embodiments, the composition of the layers is such that the inner moisture barrier 214 and outer moisture barrier 221 together do not exceed a maximum amount of plastics or non-paper components in accordance with an established standard or guideline for paper recyclability and/or repulpability.

The primer layer 222 plays a role in adhering the PVOH layer 218 to the inner moisture barrier 214. In embodiments, the primer layer 222 is a water-based or organic solvent-based primer. Exemplary primers include polyethyleneimines (PEI), ethylene-acrylic acid (EAA) copolymer resins, ethylene-ethyl acrylate (EEA) copolymer resins, polyurethanes, polyvinyl alcohols, poly acrylic acids (PAA), and polyacrylates.

The method for forming the primer layer 222 can be any method. In embodiments, the primer is a water or organic solvent based coating that can be diluted with water or organic solvent and used. The primer coating 222 is applied to the surface of a substrate suitably using a known method, such as roll coating, roll-to-roll coating, various types of gravure coating, flexographic coating, bar coating, doctor blade coating, comma coating, spraying, or brush coating.

The solvent for use in forming the primer layer 222 can be any solvent. Examples include water and alkanols, e.g., ethanol and isopropanol. The concentration of the primer can be suitably determined in accordance with coating suitability and the desired thickness or coating density of the coating film.

In certain embodiments, the primer layer 222 is applied with a coating basis weight of from about 0.25 lb/3000 $ft^2$ to about 2.0 lb/3000 $ft^2$ wet, and more preferably about 0.5 lb/3000 $ft^2$ to about 1.0 lb/3000 $ft^2$ wet.

In certain embodiments, the structure 200 includes both the inner moisture barrier 214 and the outer moisture barrier 221. In certain embodiments, the structure 200 includes the inner moisture barrier 214 and excludes the outer moisture barrier 221. In certain embodiments, the structure 200 excludes the inner moisture barrier 214 and includes the outer moisture barrier 221.

Referring now to FIG. 3A, there appears a structure 300*a* comprising a paper substrate 310, at least one of an inner moisture barrier 314 and an outer moisture barrier 321, a tie layer 316, a primer layer 322, a PVOH layer 318, and an optional printed ink layer 320.

The structure 300*a* is similar to the structure 100*a* appearing in FIG. 1A and described above, except that the three-layer moisture barrier resin-tie resin-PVOH coextrusion 112 is replaced with a two-layer moisture barrier resin-tie resin coextrusion 312 and a primer layer 322 is disposed between the tie layer 316 and the PVOH layer 318, which is brought onto the primer layer 322 in a separate step. Otherwise, the paper substrate 310, moisture barrier resin layer 314, tie layer 316, primer layer 322, PVOH layer 318, ink layer 320, and outer moisture barrier 321 are as described above. According to this form, the presence of both the tie layer 316 and the primer layer 322 enhances the adhesion between the moisture barrier resin layer 314 and the PVOH layer 318. In embodiments, the inner moisture barrier layer 314 is a coated moisture barrier layer, e.g., an extrusion coated resin layer or other coating layer such as a dried polymer dispersion layer as described above. In embodiments, if the outer moisture barrier layer 321 is present, the inner moisture barrier layer 314 can be omitted. In embodiments, if the inner moisture barrier layer 314 is present, the outer moisture barrier layer 321 can be omitted.

In certain embodiments, the composition of the layers is such that the inner moisture barrier 314, tie layer 316, and outer moisture barrier 321 together do not exceed 20% by weight of the total weight of the structure 300*a* minus the weight of the PVOH layer 318. In certain embodiments, the composition of the layers is such that the inner moisture barrier 314, tie layer 316, and outer moisture barrier 321 together do not exceed 15% by weight of the total weight of the structure 300*a* minus the weight of the PVOH layer 318. In certain embodiments, the composition of the layers is such that the inner moisture barrier 314, tie layer 316, and outer moisture barrier 321 together do not exceed 10% by weight of the total weight of the structure 300*a* minus the weight of the PVOH layer 318. In certain embodiments, the composition of the layers is such that the inner moisture barrier 314, tie layer 316, and outer moisture barrier 321 together do not exceed a maximum amount of plastics or non-paper components in accordance with an established standard or guideline for paper recyclability and/or repulpability.

In certain embodiments, the structure 300*a* includes both the inner moisture barrier 314 and the outer moisture barrier 321. In certain embodiments, the structure 300 includes the inner moisture barrier 314 and excludes the outer moisture barrier 321. In certain embodiments, the structure 300 excludes the inner moisture barrier 314 and includes the outer moisture barrier 321.

Referring now to FIG. 3B, there is shown an alternative embodiment structure 300*b*. The above description of the structure 300*a* is equally applicable to the embodiment 300*b* except that the inner moisture barrier 314 and tie layer 116 are not coextruded, but rather form separately applied layers. In certain embodiments, the structure 300*b* includes both the inner moisture barrier 314 and the outer moisture barrier 321. In certain embodiments, the structure 300*b* includes the inner moisture barrier 314 and excludes the outer moisture barrier 321. In certain embodiments, the structure 300*b* excludes the inner moisture barrier 314 and includes the outer moisture barrier 321.

Referring now to FIG. 4, there appears a structure 400 comprising a paper substrate 410, at least one of an inner moisture barrier 414 and an outer moisture barrier 421, a tie layer 416, a primer layer 422, a PVOH layer 418, and an optional printed ink layer 420. The structure 400 is similar to the structure 100*b* appearing in FIG. 1B and described above, except that an optional primer layer 422 is interposed between the PVOH-tie resin coextrusion 412 and the inner barrier 414. Otherwise, the paper substrate 410, inner moisture barrier 414, tie layer 416, primer layer 422, PVOH layer 418, ink layer 420, and outer moisture barrier 421 are as described above. In embodiments where the optional primer layer 422 is present, the presence of both the tie layer 416 and the primer layer 422 enhances the adhesion between the moisture barrier resin layer 414 and the PVOH layer 418. In embodiments, if the outer moisture barrier layer 421 is present, the inner moisture barrier layer 414 can be omitted.

In embodiments, if the inner moisture barrier layer 414 is present, the outer moisture barrier layer 421 can be omitted.

In certain embodiments, the composition of the layers is such that the inner moisture barrier 414, tie layer 416, and outer moisture barrier 421 together do not exceed 20% by weight of the total weight of the structure 400 minus the weight of the PVOH layer 418. In certain embodiments, the composition of the layers is such that the inner moisture barrier 414, tie layer 416, and outer moisture barrier 421 together do not exceed 15% by weight of the total weight of the structure 400 minus the weight of the PVOH layer 418. In certain embodiments, the composition of the layers is such that the inner moisture barrier 414, tie layer 416, and outer moisture barrier 421 together do not exceed 10% by weight of the total weight of the structure 400 minus the weight of the PVOH layer 418. In certain embodiments, the composition of the layers is such that the inner moisture barrier 414, tie layer 416, and outer moisture barrier 421 together do not exceed a maximum amount of plastics or non-paper components in accordance with an established standard or guideline for paper recyclability and/or repulpability.

In certain embodiments, the structure 400 includes both the inner moisture barrier 414 and the outer moisture barrier 421. In certain embodiments, the structure 400 includes the inner moisture barrier 414 and excludes the outer moisture barrier 421. In certain embodiments, the structure 400 excludes the inner moisture barrier 414 and includes the outer moisture barrier 421.

Turning now to FIG. 5A, a packaging structure 500*a* includes a paper substrate 510, at least one of an inner moisture barrier 514 and an outer moisture barrier 521, a PVOH layer 518, and an optional printed ink layer 520. The packaging structure 500*a* is similar to structure 100*a* appearing in FIG. 1A and described above, but in which the moisture barrier resin-tie resin-PVOH coextrusion 112 appearing in FIG. 1A has been replaced by a moisture barrier resin-PVOH coextrusion 512. Otherwise, the paper substrate 510, inner moisture barrier 514, PVOH layer 518, ink layer 520, and outer moisture barrier 521 are as described above. In embodiments, if the outer moisture barrier layer 521 is present, the inner moisture barrier layer 514 can be omitted. In embodiments, if the inner moisture barrier layer 514 is present, the outer moisture barrier layer 521 can be omitted.

In certain embodiments, the composition of the layers is such that the inner moisture barrier resin layer 514 and outer moisture barrier 521 together do not exceed 20% by weight of the total weight of the structure 500*a* minus the weight of the PVOH layer 518. In certain embodiments, the composition of the layers is such that the inner moisture barrier resin layer 514 and outer moisture barrier 521 together do not exceed 15% by weight of the total weight of the structure 500*a* minus the weight of the PVOH layer 518. In certain embodiments, the composition of the layers is such that the inner moisture barrier resin layer 514 and outer moisture barrier 521 together do not exceed 10% by weight of the total weight of the structure 500*a* minus the weight of the PVOH layer 518. In certain embodiments, the composition of the layers is such that the inner moisture barrier resin layer 514 and outer moisture barrier 521 together do not exceed a maximum amount of plastics or non-paper components in accordance with an established standard or guideline for paper recyclability and/or repulpability.

In certain embodiments, the structure 500*a* includes both the inner moisture barrier 514 and the outer moisture barrier 521. In certain embodiments, the structure 500*a* includes the inner moisture barrier 514 and excludes the outer moisture barrier 521. In certain embodiments, the structure 500*a* excludes the inner moisture barrier 514 and includes the outer moisture barrier 521.

Referring now to FIG. 5B, there is shown an alternative embodiment structure 500*b*. The above description of the structure 500*a* is equally applicable to the embodiment 500*b* except that the PVOH layer 518 and the inner moisture barrier 514 are separately applied layers. In certain embodiments, the structure 500*b* includes both the inner moisture barrier 514 and the outer moisture barrier 521. In certain embodiments, the structure 500*b* includes the inner moisture barrier 514 and excludes the outer moisture barrier 521. In certain embodiments, the structure 500*b* excludes the inner moisture barrier 514 and includes the outer moisture barrier 521.

Turning now to FIG. 6, a packaging structure 600 is illustrated, which is similar to structure 200 appearing in FIG. 2 and structure 500*a* appearing in FIG. 5A and as described above, except that the moisture barrier resin layer 614 is disposed on the exterior, i.e., the first major surface, of the paper substrate 610 and the primer layer 622 is optional. Otherwise, the paper substrate 610, inner moisture barrier 614, PVOH layer 618, ink layer 620, primer layer 622 (if present), and outer moisture barrier 621 are as described above. In embodiments, if the outer moisture barrier layer 621 is present, the inner moisture barrier layer 614 can be omitted. In embodiments, if the inner moisture barrier layer 614 is present, the outer moisture barrier layer 621 can be omitted.

In certain embodiments, the composition of the layers is such that the inner moisture barrier 614 and outer moisture barrier 621 together do not exceed 20% by weight of the total weight of the structure 600 minus the weight of the PVOH layer 618. In certain embodiments, the composition of the layers is such that the inner moisture barrier 614 and outer moisture barrier 621 together do not exceed 15% by weight of the total weight of the structure 600 minus the weight of the PVOH layer 618. In certain embodiments, the composition of the layers is such that the inner moisture barrier 614 and outer moisture barrier 621 together do not exceed 10% by weight of the total weight of the structure 600 minus the weight of the PVOH layer 618. In certain embodiments, the composition of the layers is such that the inner moisture barrier 614 and outer moisture barrier 621 together do not exceed does not exceed a maximum amount of plastics or non-paper components in accordance with an established standard or guideline for paper recyclability and/or repulpability.

The primer layer 622 may be as described above and plays a role in adhering the PVOH layer to the moisture barrier resin layer 218. To manufacture the structure 600, the moisture barrier resin layer 614, which may be a monolayer or multiple, e.g., coextruded, layers, is coated onto the first major surface of the substrate 610, e.g., using an extrusion or coextrusion coater. The exposed surface of the moisture barrier resin layer 614 is then treated, e.g., using a treater such as a flame treater, corona treater, plasma treater, or ozone treater to improve adhesion of the printed ink layer 620 and optional moisture-resistant layer 612.

The second major surface of the paper substrate layer 610 may likewise be treated, e.g., using a treater such as a flame treater, corona treater, plasma treater, or ozone treater and a primer layer 622 is applied using a wet coating process as described in greater detail below. The PVOH layer 618 is then applied to the primed second major surface of the paper substrate 610, e.g., using an extrusion coater.

In certain embodiments, the structure 600 includes both the inner moisture barrier 614 and the outer moisture barrier 621. In certain embodiments, the structure 600 includes the inner moisture barrier 614 and excludes the outer moisture barrier 621. In certain embodiments, the structure 600 excludes the inner moisture barrier 614 and includes the outer moisture barrier 621.

It should be appreciated that in the structures 100*a*, 100*b*, 200, 300*a*, 300*b*, 400, 500*a*, 500*b* and 600, the exposed face of the PVOH layer is attached on one side of or interiorly to a polymeric barrier layer which helps to protect that side of the PVOH layer from moisture and humidity and maintain a low rate of oxygen through the PVOH layer.

These structures provide a number of advantages over known flexible packaging solutions. In applications where an oxygen barrier is required, PVOH provides good oxygen barrier properties at a relatively low cost. Further, because the PVOH layer functions as both an oxygen barrier layer and a heat sealant layer, a separate heat seal layer, such as a polyethylene-based sealant layer can be omitted. In this manner, the quantity of non-cellulosic materials in the structures can be reduced to sufficiently low levels to render the structures recyclable and repulpable. In addition, because the PVOH is water soluble/dispersible, it can be separated from the structure via hot water washing during the recycling and repulping processes.

In certain embodiments, a packaging structure 100*a* has a paper substrate 110 having a basis weight of 40 lb/3,000 $ft^2$ and the inner moisture barrier 114 and the tie layer 116 taken together have a basis weight of 5 lb/3,000 $ft^2$. In certain embodiments, a packaging structure 100*b* has a paper substrate 110 having a basis weight of 40 lb/3,000 $ft^2$ and the inner moisture barrier 114 and the tie layer 116 taken together have a basis weight of 5 lb/3,000 $ft^2$. In certain embodiments, a packaging structure 200 has a paper substrate 210 having a basis weight of 40 lb/3,000 $ft^2$ and the moisture barrier resin layer has a basis weight of 5 lb/3,000 $ft^2$. In certain embodiments, a packaging structure 300*a* has a paper substrate 310 having a basis weight of 40 lb/3,000 $ft^2$ and the moisture barrier resin layer 314 and the tie layer 316 taken together have a basis weight of 5 lb/3,000 $ft^2$. In certain embodiments, a packaging structure 300*b* has a paper substrate 310 having a basis weight of 40 lb/3,000 $ft^2$ and the moisture barrier resin layer 314 and the tie layer 316 taken together have a basis weight of 5 lb/3,000 $ft^2$. In certain embodiments, a packaging structure 400 has a paper substrate 410 having a basis weight of 40 lb/3,000 $ft^2$ and the moisture barrier resin layer 414 and the tie layer 416 taken together have a basis weight of 5 lb/3,000 $ft^2$. In certain embodiments, a packaging structure 500*a* has a paper substrate 510 having a basis weight of 40 lb/3,000 $ft^2$ and the inner moisture barrier layer 514 has a basis weight of 5 lb/3,000 $ft^2$. In certain embodiments, a packaging structure 500*b* has a paper substrate 510 having a basis weight of 40 lb/3,000 $ft^2$ and the inner moisture barrier layer 514 has a basis weight of 5 lb/3,000 $ft^2$. In certain embodiments, a packaging structure 600 has a paper substrate 610 having a basis weight of 40 lb/3,000 $ft^2$ and the moisture barrier resin layer 614 has a basis weight of 5 lb/3,000 $ft^2$.

Figure 7:
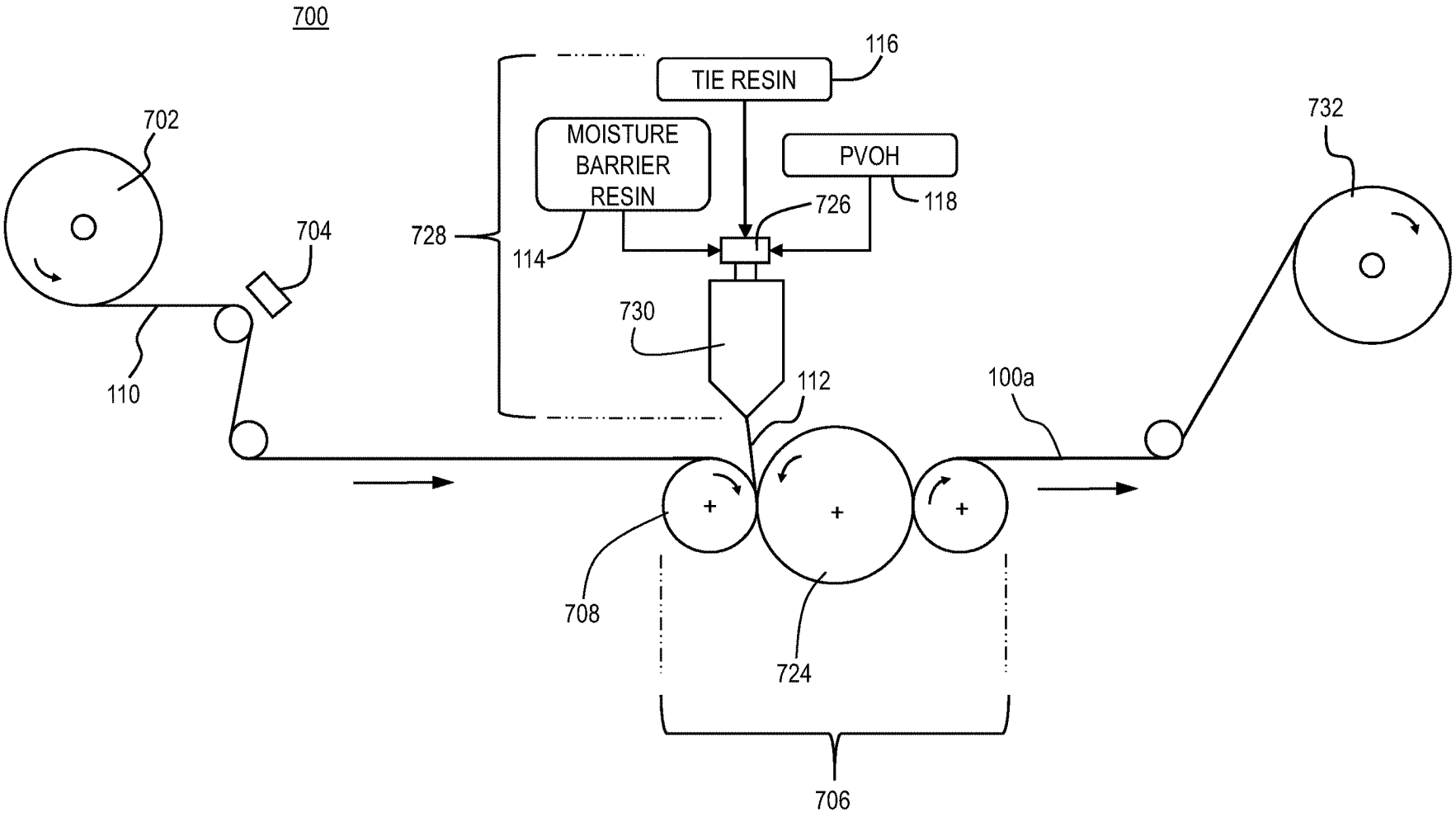
FIG. 7 illustrates an exemplary process line which may be used to make or fabricate the packaging structure appearing in FIG. 1A.

Referring now to FIG. 7, a manufacturing line 700 for making the packaging is disclosed. The line 700 illustrated is suitable for making the structures 100*a* described above. Persons skilled in the art will readily appreciate, however, that components of the line 700 may be eliminated or not used based on the desired structure of the final product.

The line 700 includes one section which forms a coextrusion laminated substrate including the paper substrate 110 with a coextrusion 112 comprising the inner moisture barrier 114, tie resin layer 116, and PVOH layer 118 to form the packaging material 100*a*.

The line 700 includes a substrate 702 comprising the paper substrate 110. In embodiments, the paper substrate 110 is preprinted with the ink layer 120 and any associated overprint layer(s). An optional moisture-resistant layer 121 may also be provided as described above. The substrate 110 is unrolled from the substrate roll 702 and fed toward a coextrusion coater 706 which coats the substrate 110 with the moisture barrier resin-tie resin-PVOH coextrusion 112.

On the way to the coextrusion laminator 706, the paper substrate 110 from the main substrate roll 702 is fed past a treater 704, such as a flame treater, corona treater, plasma treater, or ozone treater that treats the second major surface of the paper substrate 110 from the main substrate roll 702 such that the moisture barrier resin-tie resin-PVOH coextrusion 112 created at the coextrusion coater 706 will adhere well to the substrate 110. Optionally, a liquid primer might also be applied to the second major surface of the paper substrate 110 to treat the surface. Although treatment of the substrate is depicted, it should be appreciated that such treatment is not required and some paper substrate materials may not need treatment prior to application of the moisture barrier resin-tie resin-PVOH coextrusion 112.

At the coextrusion coater 706, the substrate 110 is fed through a nip point at which point the moisture barrier resin-tie resin-PVOH coextrusion 112 is applied onto the substrate 110 as a melt curtain. The nip point occurs between a nip roll 708 and a chill roll 724. A feed block 726 of the coextruder 728 receives the molten inner moisture barrier resin 114, molten tie resin 116, and molten PVOH 118. The coextrusion 112 of moisture barrier resin-tie resin-PVOH is extruded by a die 730 proximate the nip point such that the moisture barrier resin side contacts the paper substrate 110 and is cooled by the chill roll 724 to form the paper/moisture barrier resin-tie resin-PVOH structure 100*a*. After exiting the coextrusion coater 706, the packaging material 100*a* is wound up on a product wind-up roll 732.

Figure 8A:
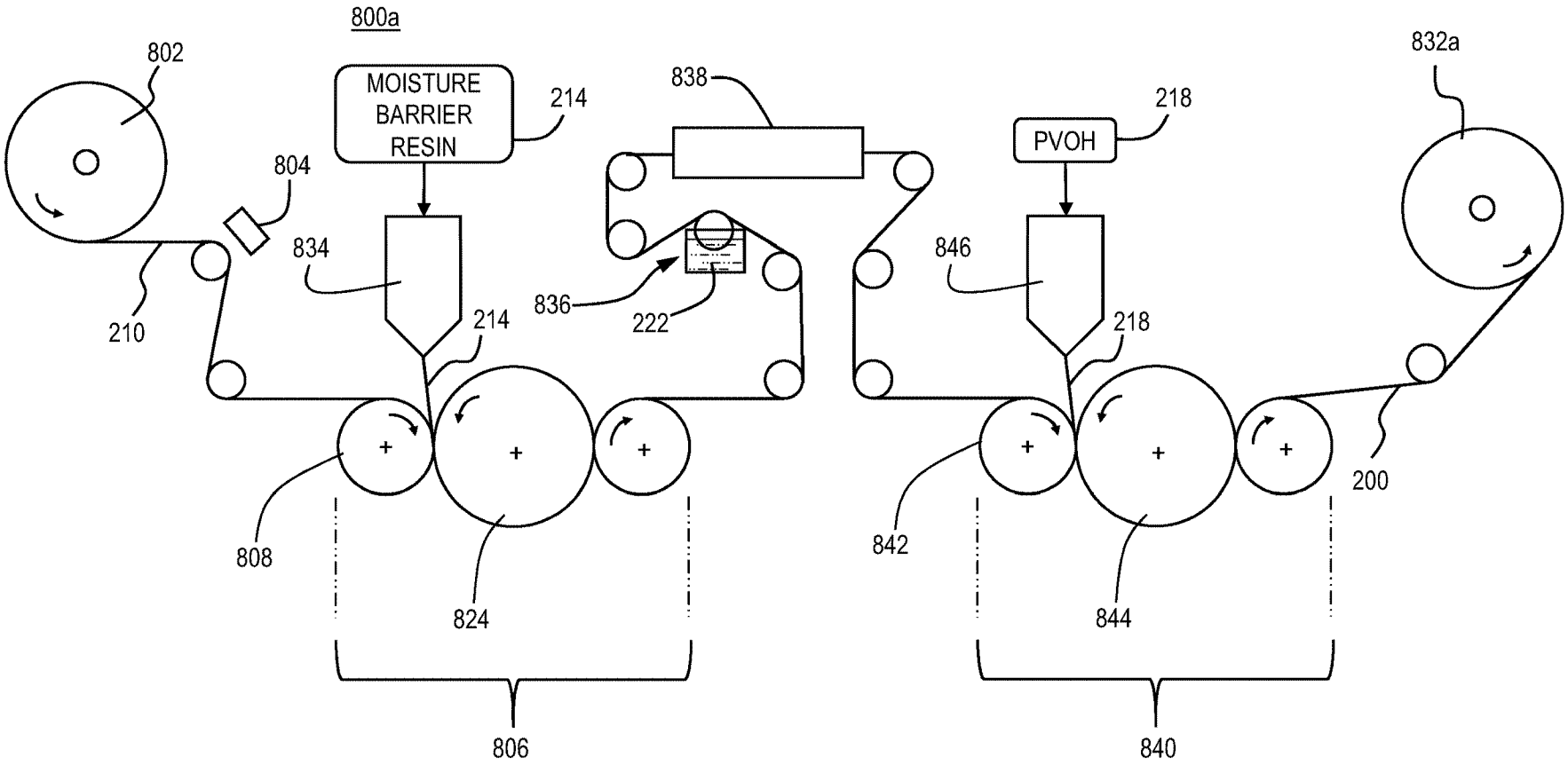
FIG. 8A illustrates an exemplary process line which may be used to make or fabricate the packaging structure appearing in FIG. 2 in a one-step process.

Referring now to FIG. 8A, a manufacturing line 800*a* for making the packaging is disclosed. The line 800*a* illustrated is suitable for making the structures 200 described above. One of ordinary skill in the art will readily appreciate, however, that segments of the line 800*a* may be eliminated or not used based on the desired structure of the final product.

The line 800*a* includes three sections. The first section forms an extrusion laminated substrate including the paper substrate 210 with the inner moisture barrier 214 thereon. The second section coats the inner moisture barrier 214 with a primer layer 222. The third section then applies the PVOH extrusion layer 218 to the primed and coated paper substrate to form the packaging material 200.

In the form shown, the first section of the line 800*a* prepares the paper substrate 210. In embodiments, the paper substrate 210 is preprinted with the ink layer 220 and any associated overprint layer(s). An optional moisture-resistant layer 221 may also be provided as described above. The substrate 210 is unrolled from a main substrate roll 802 and fed toward a first extrusion coater 806 which coats the substrate 210 with the inner moisture barrier 214.

On the way to the first extrusion laminator 806, the substrate 210 from the main substrate roll 802 is fed past a treater 804 such as a flame treater, corona treater, plasma treater, or ozone treater, that treats the second major surface of the substrate 210 from the main substrate roll 802 such that the inner moisture barrier 214 created at the first extrusion coater 806 will adhere well to the substrate. Although treatment of the substrate is depicted, it should be appreciated that such treatment is not required and some substrate materials 210 may not need treatment prior to application of the inner moisture barrier 214.

At the first extrusion coater 806, the substrate is fed through a nip point at which point the inner moisture barrier 214 is brought onto the substrate 210 as a melt curtain. The nip point occurs between a nip roll 808 and a chill roll 824. As the substrate 210 approaches the nip point, at a location above the nip point, a die 834 supplies a molten moisture barrier resin 214, which may be, for example, polyethylene or any of the moisture barrier materials listed above, as a melt curtain. This molten moisture barrier resin layer 214 is applied to the second major surface of the substrate 210 at the nip point; is cooled by the chill roll 824 to form a substrate/moisture barrier resin layer structure; and then this coated substrate exits the first extrusion coater 806.

It should be appreciated that while the line 800*a* is shown as including the first extrusion coater 806 for the formation of the substrate/moisture barrier resin layer structure, it is possible that the substrate 210 could be coated with the inner moisture barrier 214 using methods other than an extrusion coater. For example, a spray coating of the moisture barrier resin layer 214 could be applied to the paper substrate 210.

In any event, the substrate/moisture barrier resin layer structure is then fed to the second section including a coater 836. The primer layer 222 is applied to the inner moisture barrier 214 using a wet coating process. In embodiments, the primer layer 222 is applied using a roll coating process, a roll-to-roll coating process, e.g., a gravure roll or anilox roll, a flexographic process, or is applied via a slot coater. The coated primer is then dried using a heater 838.

In the third portion of the line 800*a*, a second extrusion coater 840 applies or coats the primed surface of the substrate/moisture barrier resin layer/primer structure with the PVOH layer 218 to form the packaging structure 200. In the second extrusion coater 840, the substrate/moisture barrier resin layer/primer structure is fed between a nip roll 842 and a chill roll 844. An extrusion of molten PVOH 218 is extruded by a die 846 proximate the nip point such that the PVOH contacts the primed surface of the substrate/moisture barrier resin layer/primer structure and is cooled by the chill roll 844 to form the paper/moisture barrier resin/primer/PVOH structure 200. After exiting the second extrusion coater 840, the packaging structure 200 is wound up on a product wind-up roll 832*a*.

Figure 8B:
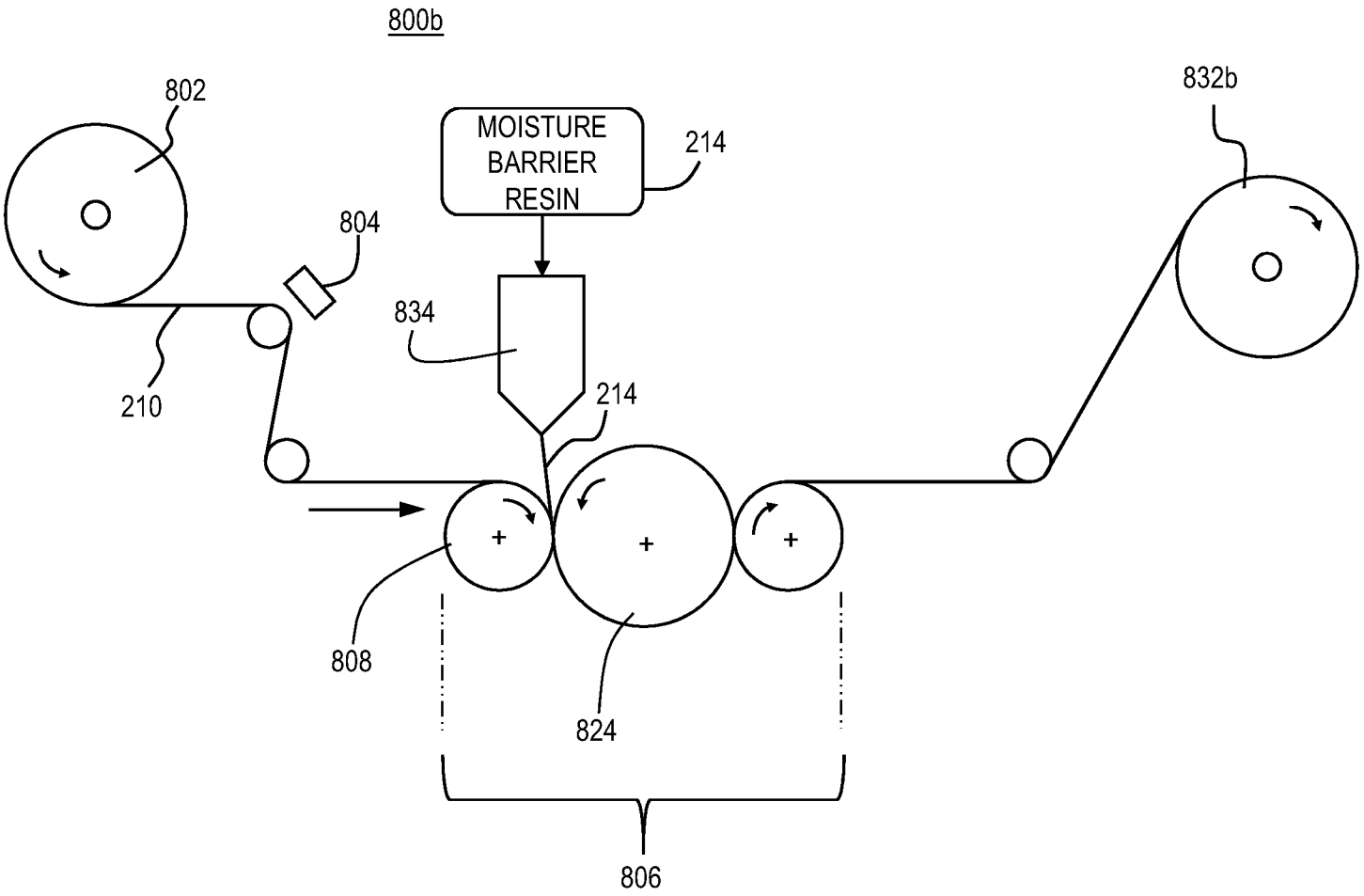
FIGS. 8B and 8C illustrate first and second exemplary process lines which may be used to make or fabricate the packaging structure appearing in FIG. 2 in a two-step process.

Referring now to FIG. 8B, a manufacturing line 800*b* for making the packaging is disclosed. The line 800*b* illustrated is suitable for making the substrate/moisture barrier resin layer structure as described above. One of ordinary skill in the art will readily appreciate, however, that segments of the line 800*b* may be eliminated or not used based on the desired structure of the final product.

In the form shown, the line 800*b* prepares the paper substrate 210. In embodiments, the paper substrate 210 is preprinted with the ink layer 220 and any associated overprint layer(s). An optional moisture-resistant layer 221 may also be provided as described above. The substrate 210 is unrolled from a main substrate roll 802 and fed toward an extrusion coater 806 which coats the substrate 210 with the inner moisture barrier 214.

On the way to the extrusion laminator 806, the substrate 210 from the main substrate roll 802 is fed past a treater 804 such as a flame treater, corona treater, plasma treater, or ozone treater, that treats the second major surface of the substrate 210 from the main substrate roll 802 such that the inner moisture barrier 214 created at the extrusion coater 806 will adhere well to the substrate 210. Although treatment of the substrate is depicted, it should be appreciated that such treatment is not required and some substrate materials 210 may not need treatment prior to application of the inner moisture barrier 214.

At the extrusion coater 806, the substrate is fed through a nip point at which point the inner moisture barrier layer 214 is applied onto the substrate 210 as a melt curtain. The nip point occurs between a nip roll 808 and a chill roll 824. As the substrate 210 approaches the nip point, at a location above the nip point, a die 834 supplies a molten inner moisture barrier resin layer 214, which may be, for example, polyethylene or any of the moisture barrier materials listed above, as a melt curtain. This molten moisture barrier resin layer 214 is applied to the second major surface of the substrate 210 at the nip point; is cooled by the chill roll 824 to form a substrate/moisture barrier resin layer structure; and then this coated substrate exits the extrusion coater 806.

It should be appreciated that while the line 800*b* is shown as including the extrusion coater 806 for the formation of the substrate/moisture barrier resin layer structure, it is possible that the substrate 210 could be coated with the inner moisture barrier resin layer 214 using methods other than an extrusion coater. For example, a spray coating of the inner moisture barrier 214 could be applied to the paper substrate 210.

In any event, after exiting the extrusion coater 806, the substrate/moisture barrier resin layer structure is wound up on a product wind-up roll 832*b* for later processing, as described in FIG. 8C.

Figure 8C:
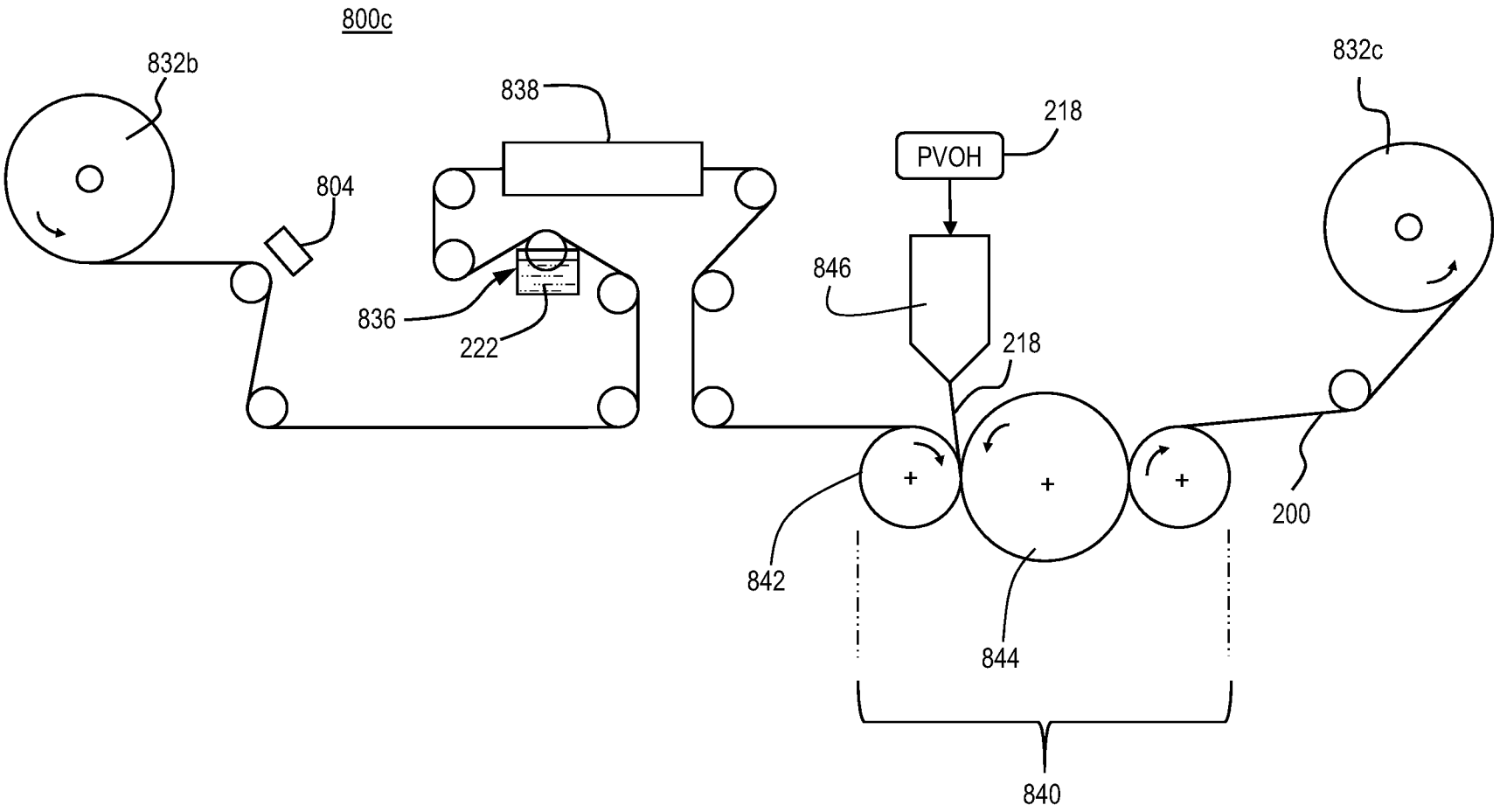

Referring now to FIG. 8C, a manufacturing line 800*c* for making the packaging is disclosed. The line 800*c* illustrated is suitable for making the structures 200 described above. One of ordinary skill in the art will readily appreciate, however, that segments of the line 800*c* may be eliminated or not used based on the desired structure of the final product.

The line 800*c* includes two sections. The first section applies the primer layer 222 to an extrusion laminated substrate including the paper substrate 210 with the inner moisture layer 214 thereon. The second section applies the PVOH extrusion layer 218 to the primed and coated paper substrate to form the packaging material 200.

In the form shown, the first section of the line 800*c* prepares the substrate/moisture barrier resin layer structure. The substrate/moisture barrier resin layer structure is unrolled from a main roll 832*b* and fed toward a wet process coater 836 which coats the substrate 210 with the primer 222.

On the way to the coater 836, the substrate/moisture barrier resin layer structure from the coated substrate roll 832*b* is fed past a treater 804 such as a flame treater, corona treater, plasma treater, or ozone treater, that treats the moisture barrier surface of the substrate/moisture barrier resin layer structure from the coated substrate roll 832*b* such that the primer layer 222 and the PVOH layer 218 will adhere well to the substrate/moisture barrier resin layer structure. Although treatment of the substrate/moisture barrier resin layer structure is depicted, it should be appreciated that such treatment is not required and some materials may not need treatment prior to application of the primer and PVOH layers 222 and 218, respectively.

At the coater 836, the primer layer 222 is applied to the inner moisture barrier 214 using a wet coating process. In embodiments, the primer is applied using a roll coating process, a roll-to-roll coating process, e.g., a gravure roll or anilox roll, a flexographic process, or is applied via a slot coater. The coated primer is then dried using a heater 838.

In the second portion of the line 800*c*, an extrusion coater 840 applies or coats the primed surface of the substrate/moisture barrier resin layer/primer structure with the PVOH layer 218 to form the packaging structure 200. In the second extrusion coater 840, the substrate/moisture barrier resin layer/primer structure is fed between a nip roll 842 and a chill roll 844. An extrusion of molten PVOH 218 is extruded by a die 846 proximate the nip point such that the PVOH contacts the primed surface of the substrate/moisture barrier resin layer/primer structure and is cooled by the chill roll 844 to form the paper/moisture barrier resin/primer/PVOH structure 200. After exiting the second extrusion coater 840, the packaging structure 200 is wound up on a product wind-up roll 832*c*.

Figure 9A:
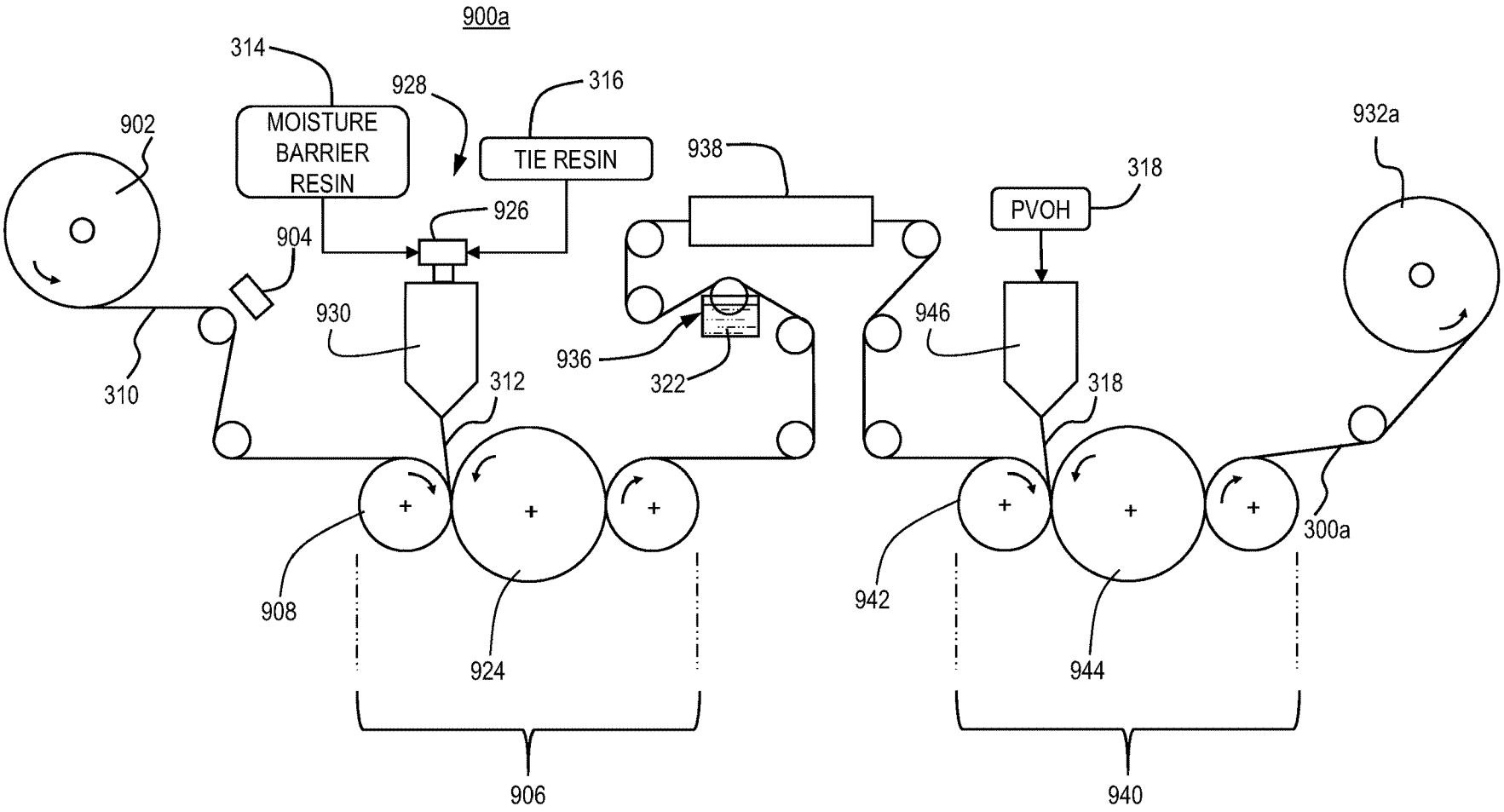
FIG. 9A illustrates an exemplary process line which may be used to make or fabricate the packaging structure appearing in FIG. 3A in a one-step process.

Referring now to FIG. 9A, a manufacturing line 900*a* for making the packaging is disclosed. The line 900*a* illustrated is suitable for making the structures 300*a* described above. One of ordinary skill in the art will readily appreciate, however, that segments of the line 900*a* may be eliminated or not used based on the desired structure of the final product.

The line 900*a* includes three sections. The first section forms a coextrusion laminated substrate including the paper substrate 310 with a coextrusion comprising the moisture barrier resin layer 314 and tie resin layer 316 thereon. The second section coats the paper substrate/moisture barrier resin-tie resin structure with a primer layer 322. The third section then applies the PVOH extrusion layer 318 to the primed and coated paper substrate to form the packaging material 300*a*.

In the form shown, the first section of the line 900*a* prepares the paper substrate 310. In embodiments, the paper substrate 310 is preprinted with the ink layer 320 and any associated overprint layer(s). An optional moisture-resistant layer 321 may also be provided as described above. The substrate 310 is unrolled from a main substrate roll 902 and fed toward a coextrusion coater 906 which coats the substrate 310 with a coextrusion comprising the moisture barrier resin layer 314 and the tie resin layer 316.

On the way to the coextrusion laminator 906, the substrate 310 from the main substrate roll 902 is fed past a treater 904 such as a flame treater, corona treater, plasma treater, or ozone treater, that treats the second major surface of the substrate 310 from the main substrate roll 902 such that the moisture barrier resin-tie resin coextrusion 312 created at the coextrusion coater 906 will adhere well to the substrate 310. Although treatment of the substrate 310 is depicted, it should be appreciated that such treatment is not required and some substrate materials 310 may not need treatment prior to application of the moisture barrier resin-tie resin coextrusion 312.

At the coextrusion coater 906, the substrate 310 is fed through a nip point at which point the moisture barrier resin-tie resin coextrusion 312 is applied onto the substrate 310 as a melt curtain. The nip point occurs between a nip roll 908 and a chill roll 924. A feed block 926 of the coextruder 928 receives molten moisture barrier resin 314 and molten tie resin 316. As the substrate 310 approaches the nip point, at a location above the nip point, the coextrusion 312 of moisture barrier resin-tie resin is extruded by a die 930 proximate the nip point such that the moisture barrier resin layer side contacts the paper substrate 310 and is cooled by the chill roll 924 to form a paper/moisture barrier resin-tie resin structure and then this coated substrate exits the coextrusion coater 906.

It should be appreciated that while the line 900*a* is shown as including the coextrusion coater 906 for the formation of the substrate/moisture barrier resin-tie resin structure, it is possible that the substrate 310 could be coated with the moisture barrier resin layer 314 and the tie resin layer 316 using methods other than a coextrusion coater. For example, the moisture barrier resin layer 314 and tie resin layer 316 could be brought onto the substrate 310 in separate mono-extrusion steps. Alternatively, spray coatings of the moisture barrier resin layer 314 and tie resin layer 316 could be applied to the paper substrate 310.

In any event, the substrate/moisture barrier resin-tie layer structure is then fed to the second section including a coater 936. The primer layer 322 is applied to the moisture barrier resin layer 314 using a wet coating process. In embodiments, the primer layer 322 is applied using a roll coating process, a roll-to-roll coating process, e.g., a gravure roll or anilox roll, a flexographic process, or is applied via a slot coater. The coated primer is then dried using a heater 938.

In the third portion of the line 900*a*, an extrusion coater 940 applies or coats the primed surface of the substrate/moisture barrier resin-tie resin/primer structure with the PVOH layer 318 to form the packaging structure 300*a*. In the extrusion coater 940, the substrate/moisture barrier resin-tie resin/primer structure is fed between a nip roll 942 and a chill roll 944. An extrusion of molten PVOH 318 is extruded by a die 946 proximate the nip point such that the PVOH contacts the primed surface of the substrate/moisture barrier resin-tie resin/primer structure and is cooled by the chill roll 944 to form the paper/moisture barrier resin-tie resin/primer/PVOH structure 300*a*. After exiting the extrusion coater 940, the packaging structure 300*a* is wound up on a product wind-up roll 932*a*.

Figure 9B:
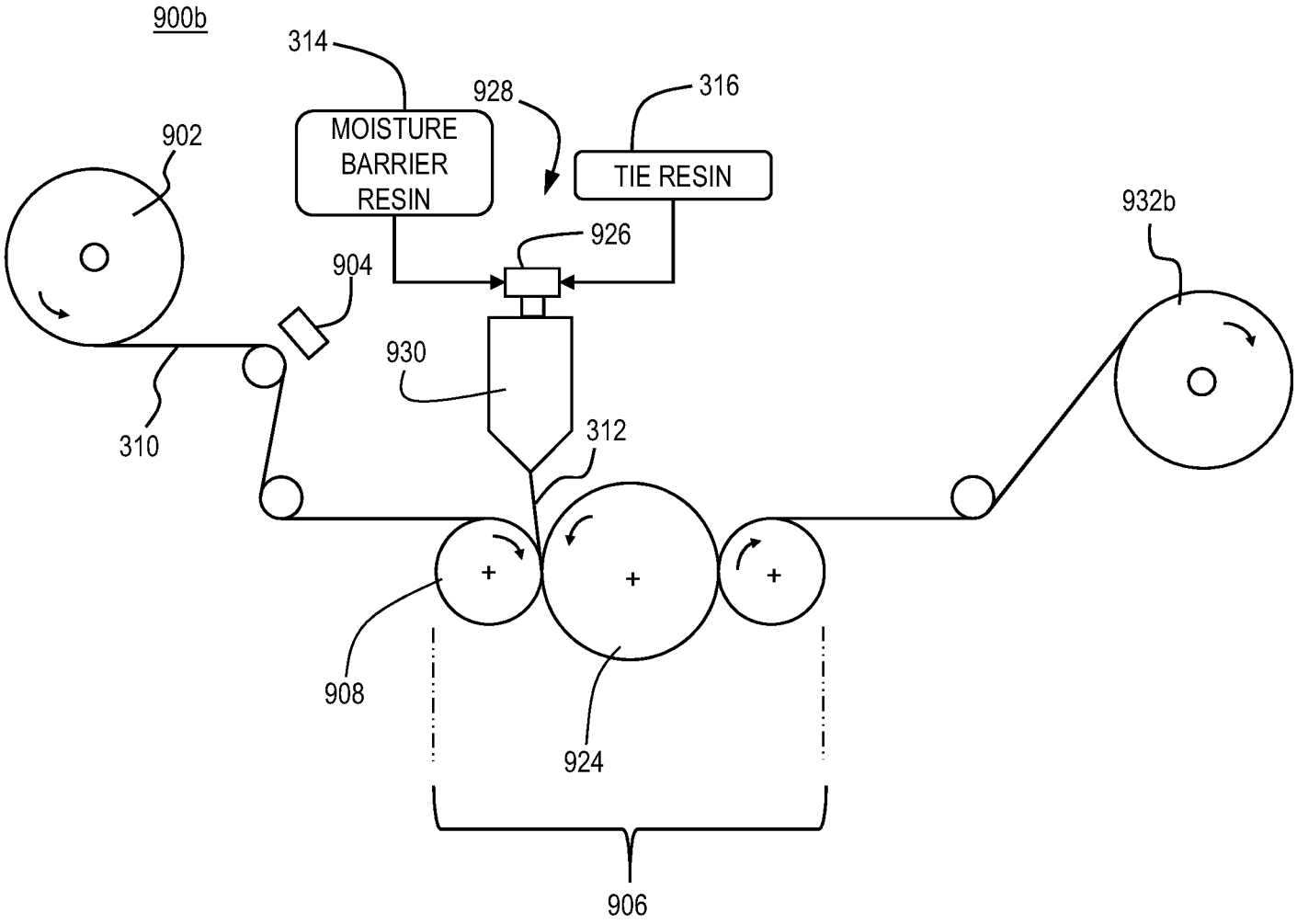
FIGS. 9B and 9C illustrate first and second exemplary process lines which may be used to make or fabricate the packaging structure appearing in FIG. 3A in a two-step process.

Referring now to FIG. 9B, a manufacturing line 900*b* for making the packaging is disclosed. The line 900*b* illustrated is suitable for making the substrate/moisture barrier resin-tie resin structure as described above. One of ordinary skill in the art will readily appreciate, however, that segments of the line 900*b* may be eliminated or not used based on the desired structure of the final product.

In the form shown, the line 900*b* prepares the paper substrate 310. In embodiments, the paper substrate 310 is preprinted with the ink layer 320 and any associated overprint layer(s). An optional moisture-resistant layer 321 may also be provided as described above. The substrate 310 is unrolled from a main substrate roll 902 and fed toward a coextrusion coater 906 which coats the substrate 910 with the moisture barrier resin-tie resin coextrusion 312.

On the way to the coextrusion laminator 906, the substrate 310 from the main substrate roll 902 is fed past a treater 904 such as a flame treater, corona treater, plasma treater, or ozone treater, that treats the second major surface of the substrate 310 from the main substrate roll 902 such that the moisture barrier resin-tie resin coextrusion 312 created at the coextrusion coater 906 will adhere well to the substrate 310. Although treatment of the substrate 310 is depicted, it should be appreciated that such treatment is not required and some substrate materials 310 may not need treatment prior to application of the moisture barrier resin-tie resin coextrusion 312.

At the coextrusion coater 906, the substrate 310 is fed through a nip point at which point the moisture barrier resin-tie resin coextrusion 312 is applied onto the substrate 310 as a melt curtain. The nip point occurs between a nip roll 908 and a chill roll 924. A feed block 926 of the coextruder 928 receives molten moisture barrier resin material 314 and molten tie resin 316. As the substrate 310 approaches the nip point, at a location above the nip point, the two layer coextrusion 312 of moisture barrier resin-tie resin is extruded by a die 930 proximate the nip point such that the moisture barrier resin layer side contacts the paper substrate 310 and is cooled by the chill roll 924 to form a paper/moisture barrier resin-tie resin structure and then this coated substrate exits the coextrusion coater 906.

It should be appreciated that while the line 900*b* is shown as including the coextrusion coater 906 for the formation of the substrate/moisture barrier resin-tie resin structure, it is possible that the substrate 310 could be coated with the moisture barrier resin layer 314 and the tie resin layer 316 using methods other than a coextrusion coater. For example, the moisture barrier resin layer 314 and the tie resin layer 316 could be brought onto the substrate 310 in separate monoextrusion steps. Alternatively, spray coatings of the moisture barrier resin layer 314 and tie resin layer 316 could be applied to the paper substrate 310.

In any event, after exiting the coextrusion coater 906, the substrate/moisture barrier resin-tie resin structure is wound up on a product wind-up roll 932*b* for later processing, as described in FIG. 9C.

Figure 9C:
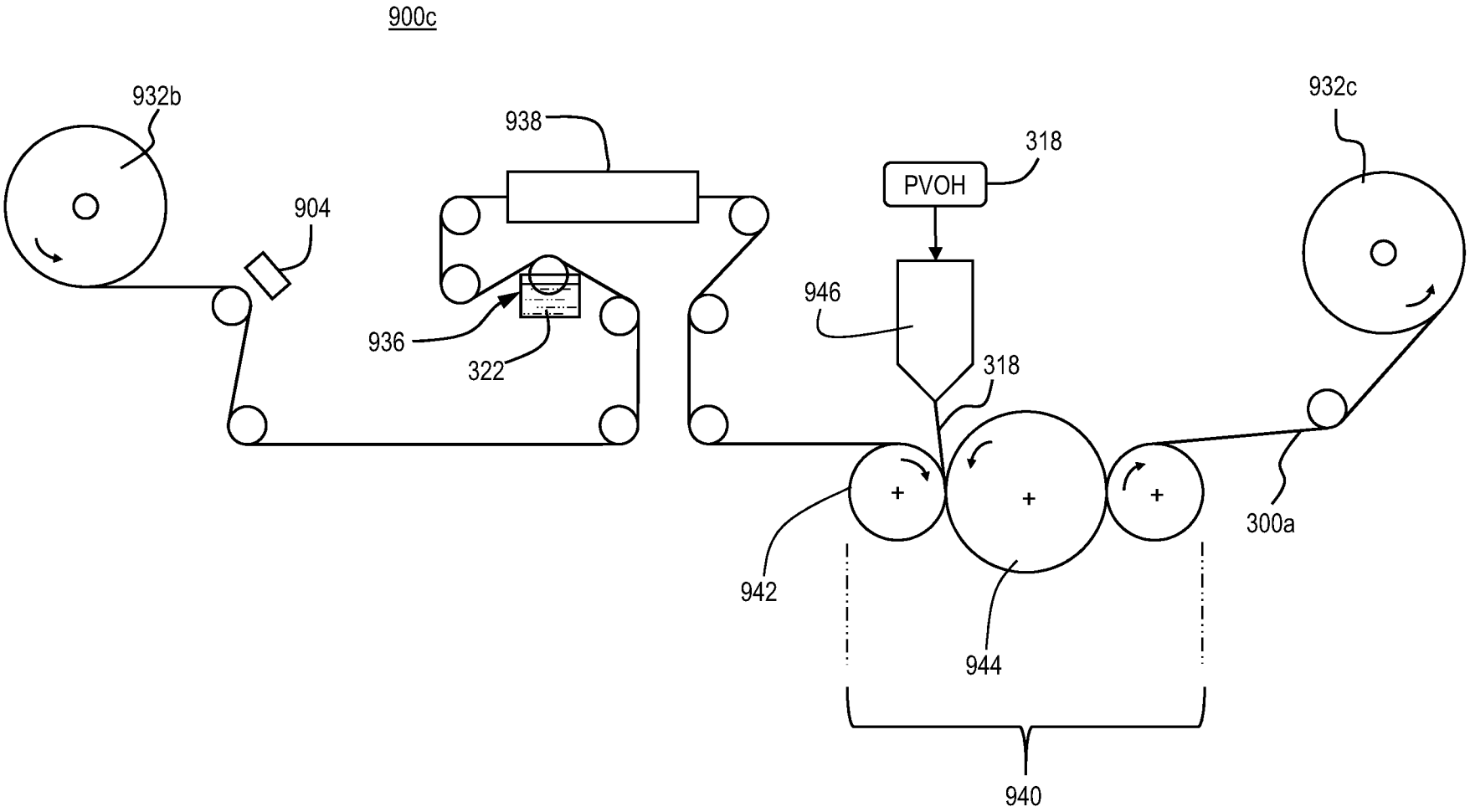

Referring now to FIG. 9C, a manufacturing line 900*c* for making the packaging is disclosed. The line 900*c* illustrated is suitable for making the structures 300*a* described above. One of ordinary skill in the art will readily appreciate, however, that segments of the line 900*c* may be eliminated or not used based on the desired structure of the final product.

The line 900*c* includes two sections. The first section applies the primer layer 322 to the coextrusion laminated substrate including the paper substrate 310 with the moisture barrier resin-tie resin coextrusion 312 thereon. The second section applies the PVOH extrusion layer 318 to the primed and coated paper substrate to form the packaging material 300*a*.

In the form shown, the first section of the line 900*c* prepares the substrate/moisture barrier resin-tie resin structure. The substrate/moisture barrier resin-tie resin structure is unrolled from a main roll 932*b* and fed toward a wet process coater 936 which coats the tie resin side of the substrate/moisture barrier resin-tie resin structure with the primer 322.

On the way to the coater 936, the substrate/moisture barrier resin-tie resin structure from the coated substrate roll 932*b* is fed past a treater 904 such as a flame treater, corona treater, plasma treater, or ozone treater, that treats the moisture barrier resin surface of the substrate/moisture barrier resin layer structure from the coated substrate roll 932*b* such that the primer layer 322 and the PVOH layer 318 will adhere well to the substrate/moisture barrier resin layer structure. Although treatment of the substrate/moisture barrier resin-tie resin structure is depicted, it should be appreciated that such treatment is not required and some materials may not need treatment prior to application of the primer and PVOH layers 322 and 318, respectively.

At the coater 936, the primer layer 322 is applied to the moisture barrier resin layer 314 using a wet coating process. In embodiments, the primer is applied using a roll coating process, a roll-to-roll coating process, e.g., a gravure roll or anilox roll, a flexographic process, or is applied via a slot coater. The coated primer is then dried using a heater 938.

In the second portion of the line 900*c*, an extrusion coater 940 applies or coats the primed surface of the substrate/moisture barrier resin-tie resin/primer structure with the PVOH layer 318 to form the packaging structure 300*a*. In the extrusion coater 940, the substrate/moisture barrier resin-tie resin/primer structure is fed between a nip roll 942 and a chill roll 944. An extrusion of molten PVOH 318 is extruded by a die 946 proximate the nip point such that the PVOH contacts the primed surface of the substrate/moisture barrier resin-tie resin/primer structure and is cooled by the chill roll 944 to form the paper/moisture barrier resin-tie resin/primer/PVOH structure 300*a*. After exiting the extrusion coater 940, the packaging structure 300*a* is wound up on a product wind-up roll 932*c*.

Figure 10A:
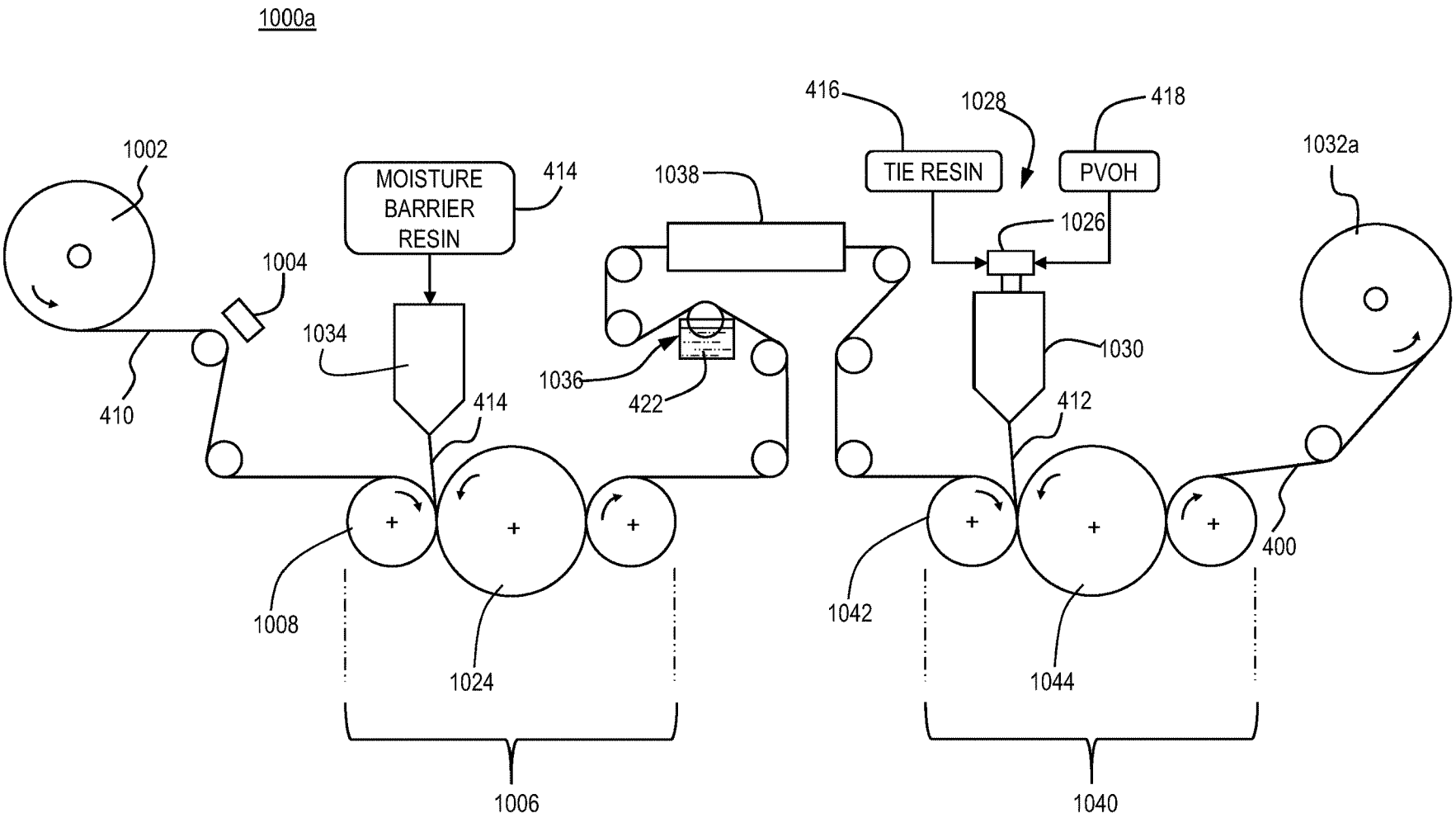
FIG. 10A illustrates an exemplary process line which may be used to make or fabricate the packaging structure appearing in FIG. 4 in a one-step process.

Referring now to FIG. 10A, a manufacturing line 1000*a* for making the packaging is disclosed. The line 1000*a* illustrated is suitable for making the structures 400 described above. One of ordinary skill in the art will readily appreciate, however, that segments of the line 1000*a* may be eliminated or not used based on the desired structure of the final product.

The line 1000*a* includes three sections. The first section forms an extrusion laminated substrate including the paper substrate 410 with the moisture barrier resin layer 414 thereon. The second section is optional and, if present, coats the moisture barrier resin layer 414 with a primer layer 422. The third section then applies a tie resin-PVOH coextrusion layer 412 to the optionally primed, moisture barrier resin-coated paper substrate to form the packaging material 400.

In the form shown, the first section of the line 1000*a* prepares the paper substrate 410. In embodiments, the paper substrate 410 is preprinted with the ink layer 420 and any associated overprint layer(s). An optional moisture-resistant layer 421 may also be provided as described above. The substrate 410 is unrolled from a main substrate roll 1002 and fed toward a first extrusion coater 1006 which coats the substrate 410 with the moisture barrier resin layer 414.

On the way to the first extrusion laminator 1006, the substrate 410 from the main substrate roll 1002 is fed past a treater 1004 such as a flame treater, corona treater, plasma treater, or ozone treater, that treats the second major surface of the substrate 410 from the main substrate roll 1002 such that the moisture barrier resin layer 414 created at the first extrusion coater 1006 will adhere well to the substrate 410. Although treatment of the substrate is depicted, it should be appreciated that such treatment is not required and some substrate materials 410 may not need treatment prior to application of the moisture barrier resin layer 414.

At the first extrusion coater 1006, the substrate 410 is fed through a nip point at which point the moisture barrier resin layer 414 is brought onto the substrate 410 as a melt curtain. The nip point occurs between a nip roll 1008 and a chill roll 1024. As the substrate 410 approaches the nip point, at a location above the nip point, a die 1034 supplies a molten moisture barrier resin layer 414, which may be, for example, polyethylene or any of the polyolefin or functionalized polyolefin moisture barrier materials listed above, as a melt curtain. This molten moisture barrier resin layer 414 is applied to the second major surface of the substrate 410 at the nip point; is cooled by the chill roll 1024 to form a substrate/moisture barrier resin layer structure; and then this coated substrate exits the first extrusion coater 1006.

It should be appreciated that while the line 1000*a* is shown as including the first extrusion coater 1006 for the formation of the substrate/moisture barrier resin layer structure, it is possible that the substrate 410 could be coated with the moisture barrier resin layer 414 using methods other than an extrusion coater. For example, a spray coating of the moisture barrier resin layer 414 could be applied to the paper substrate 410.

In any event, the substrate/moisture barrier resin layer structure is then fed to the optional second section including a coater 1036. In embodiments where in the primer layer 422 is to be applied, the primer layer 422 is applied to the moisture barrier resin layer 414 using a wet coating process. In embodiments, the primer layer 422 is applied using a roll coating process, a roll-to-roll coating process, e.g., a gravure roll or anilox roll, a flexographic process, applied via a slot coater, and so forth. The coated primer is then dried using a heater 1038.

In the third portion of the line 1000*a*, a second extrusion coater 1040 applies or coats the optionally primed surface of the substrate/moisture barrier resin layer structure with a coextrusion comprising the tie resin 416 and PVOH 418 to form the packaging structure 400. At the coextrusion coater 1040, the optionally primed substrate/moisture barrier resin layer structure is fed through a nip point at which point the tie resin-PVOH coextrusion 412 is applied onto the moisture barrier resin-coated substrate as a melt curtain. The nip point occurs between a nip roll 1042 and a chill roll 1044. A feed block 1026 of a coextruder 1028 receives molten tie resin 416 and molten PVOH 418. As the moisture barrier resin-coated substrate approaches the nip point, at a location above the nip point, a two layer coextrusion 412 of tie resin-PVOH is extruded by a die 1030 proximate the nip point such that the tie resin side of the coextrusion contacts the optionally primed moisture barrier resin-coated surface as a melt curtain and is cooled by the chill roll 1044 to form the structure 400. After exiting the coextrusion coater 1040, the packaging structure 400 is wound up on a product wind-up roll 1032*a*.

Figure 10B:
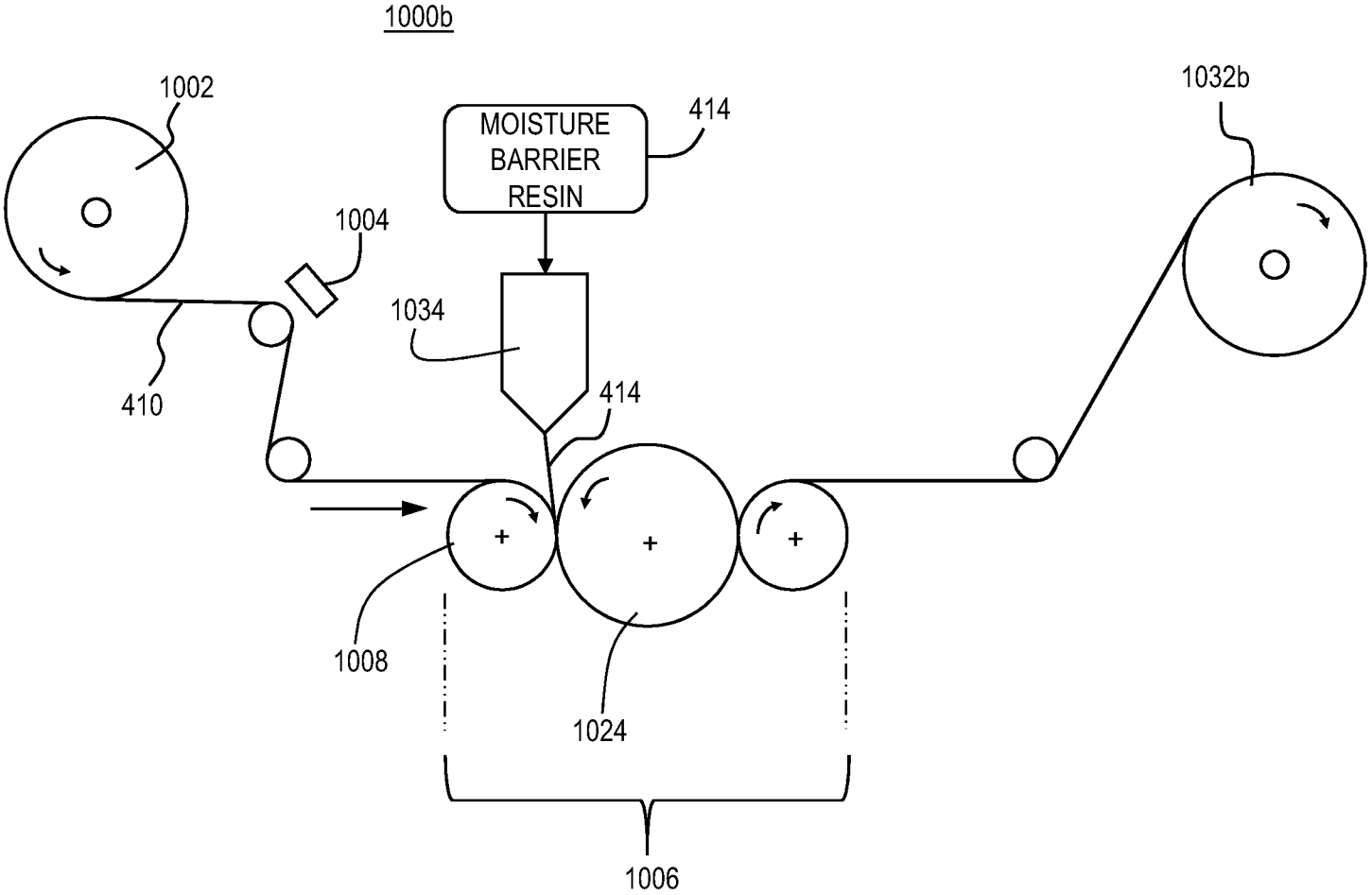
FIGS. 10B and 10C illustrate first and second exemplary process lines which may be used to make or fabricate the packaging structure appearing in FIG. 4 in a two-step process.
Figure 10C:
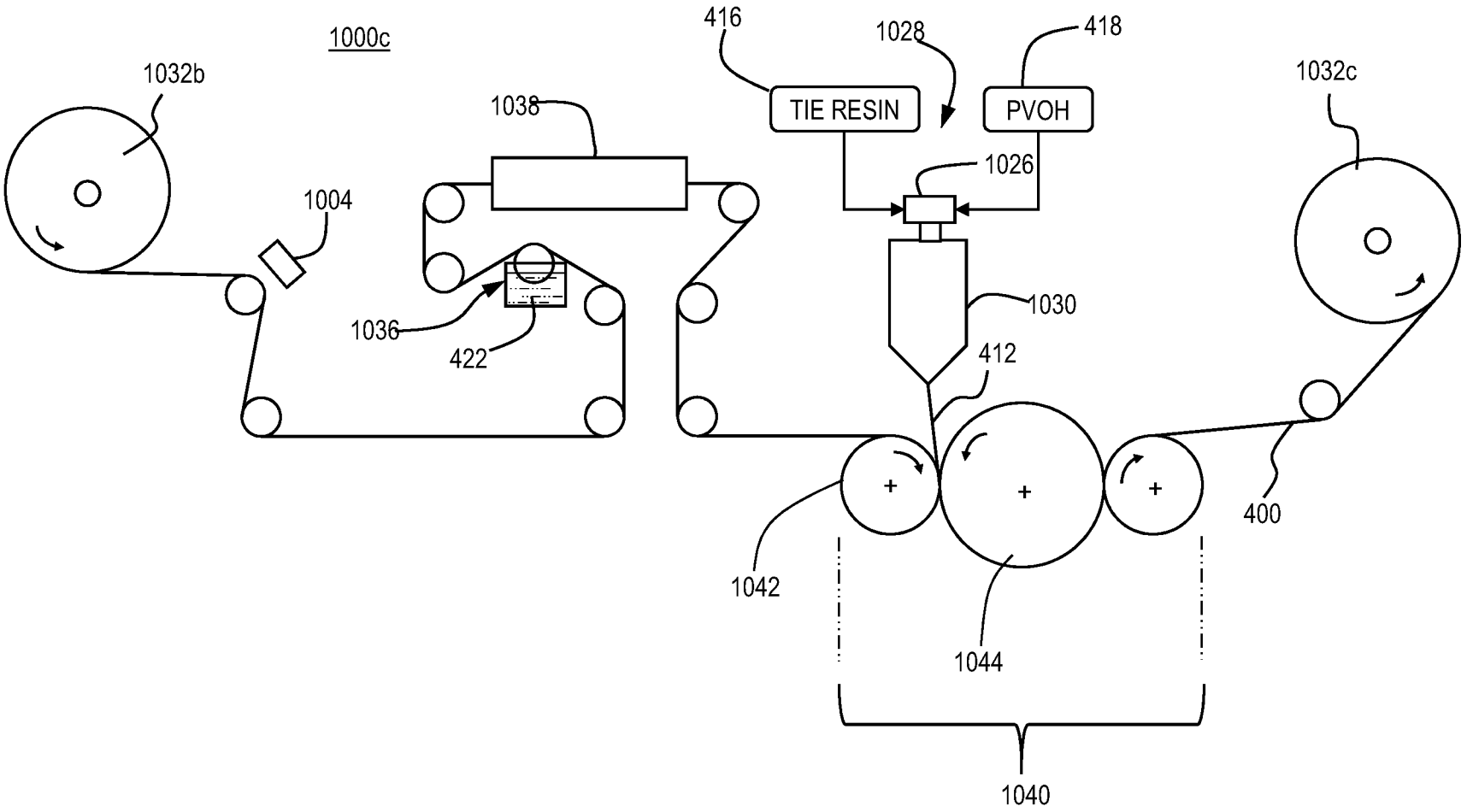

FIGS. 10B and 10C illustrate manufacturing lines 1000*b* and 1000*c*, respectively, for making the packaging material 400. The line 1000*b* illustrated is suitable for making the substrate/moisture barrier resin layer structure as described above. One of ordinary skill in the art will readily appreciate, however, that segments of the line 1000*b* may be eliminated or not used based on the desired structure of the final product.

In the form shown, the line 1000*b* prepares the paper substrate 410. In embodiments, the paper substrate 410 is preprinted with the ink layer 420 and any associated overprint layer(s). An optional moisture-resistant layer 421 may also be provided as described above. The substrate 410 is unrolled from a main substrate roll 1002 and fed toward an extrusion coater 1006 which coats the substrate 410 with the moisture barrier resin layer 414.

On the way to the extrusion laminator 1006, the substrate 410 from the main substrate roll 1002 is fed past a treater 1004 such as a flame treater, corona treater, plasma treater, or ozone treater, that treats the second major surface of the substrate 410 from the main substrate roll 1002 such that the moisture barrier resin layer 414 created at the extrusion coater 1006 will adhere well to the substrate 410. Although treatment of the substrate is depicted, it should be appreciated that such treatment is not required and some substrate materials 410 may not need treatment prior to application of the moisture barrier resin layer 414.

At the extrusion coater 1006, the substrate is fed through a nip point at which point the moisture barrier resin layer 414 is applied onto the substrate 410 as a melt curtain. The nip point occurs between a nip roll 1008 and a chill roll 1024. As the substrate 410 approaches the nip point, at a location above the nip point, a die 1034 supplies a molten moisture barrier resin layer 414, which may be, for example, polyethylene or any of the polyolefin or functionalized polyolefin moisture barrier materials listed above, as a melt curtain. This molten moisture barrier resin layer 414 is applied to the second major surface of the substrate 410 at the nip point; is cooled by the chill roll 1024 to form a substrate/moisture barrier resin layer structure; and then this coated substrate exits the extrusion coater 1006.

It should be appreciated that while the line 1000*b* is shown as including the extrusion coater 1006 for the formation of the substrate/moisture barrier resin layer structure, it is possible that the substrate 410 could be coated with the moisture barrier resin layer 414 using methods other than an extrusion coater. For example, a spray coating of the moisture barrier resin layer 414 could be applied to the paper substrate 410.

In any event, after exiting the extrusion coater 1006, the substrate/moisture barrier resin layer structure is wound up on a product wind-up roll 1032*b* for later processing, as described in FIG. 10C.

Referring now to FIG. 10C, a manufacturing line 1000*c* for making the packaging is disclosed. The line 1000*c* illustrated is suitable for making the structures 400 described above. One of ordinary skill in the art will readily appreciate, however, that segments of the line 1000*c* may be eliminated or not used based on the desired structure of the final product.

The line 1000*c* includes two sections. The first section is optional and, if present, applies the primer layer 422 to an extrusion laminated substrate including the paper substrate 410 with the moisture barrier resin layer 414 thereon. The second section applies a tie resin-PVOH coextrusion 412 to the optionally primed and coated paper substrate to form the packaging material 400.

In the form shown, the first section of the line 1000*c* optionally primes the moisture barrier resin surface of the substrate/moisture barrier resin layer structure. The substrate/moisture barrier resin layer structure is unrolled from a main roll 1032*b* and fed toward a wet process coater 1036 which coats the moisture barrier resin-coated surface of the moisture barrier resin/substrate structure with the primer 422.

On the way to the coater 1036, the substrate/moisture barrier resin layer structure from the coated substrate roll 1032*b* is fed past a treater 1004 such as a flame treater, corona treater, plasma treater, or ozone treater, that treats the moisture barrier resin surface of the substrate/moisture barrier resin layer structure from the coated substrate roll 1032*b* such that the optional primer layer 422 and the tie resin-PVOH layer 412 will adhere well to the substrate/moisture barrier resin layer structure. Although treatment of the substrate/moisture barrier resin layer structure is depicted, it should be appreciated that such treatment is not required and some materials may not need treatment prior to application of the optional primer 422 and the tie resin-PVOH coextrusion 412.

At the coater 1036, the primer layer 422 is applied to the moisture barrier resin layer 414 using a wet coating process. In embodiments, the primer is applied using a roll coating process, a roll-to-roll coating process, e.g., a gravure roll or anilox roll, a flexographic process, or is applied via a slot coater. The coated primer is then dried using a heater 1038.

In the second portion of the line 1000*c*, a coextrusion coater 1040 applies or coats the optionally primed surface of the substrate/moisture barrier resin layer structure with a coextrusion comprising the tie resin 416 and PVOH 418 to form the packaging structure 400. At the coextrusion coater 1040, the optionally primed substrate/moisture barrier resin layer structure is fed through a nip point at which point the tie resin-PVOH coextrusion 412 is applied onto the moisture barrier resin-coated substrate as a melt curtain. The nip point occurs between a nip roll 1042 and a chill roll 1044. A feed block 1026 of a coextruder 1028 receives molten tie resin 416 and molten PVOH 418. As the moisture barrier resin-coated substrate approaches the nip point, at a location above the nip point, a two layer coextrusion 412 of tie resin-PVOH is extruded by a die 1030 proximate the nip point such that the tie resin side of the coextrusion contacts the optionally primed moisture barrier resin-coated surface as a melt curtain and is cooled by the chill roll 1044 to form the structure 400. After exiting the coextrusion coater 1040, the packaging structure 400 is wound up on a product wind-up roll 1032*c*.

In still further embodiments, a further production line and method for preparing the packaging structure 400 is contemplated which is as described above by way of reference to FIGS. 10A-10C, except wherein the tie resin layer 416 and the PVOH layer 418 are applied as separate monoextrusions.

Figure 11:
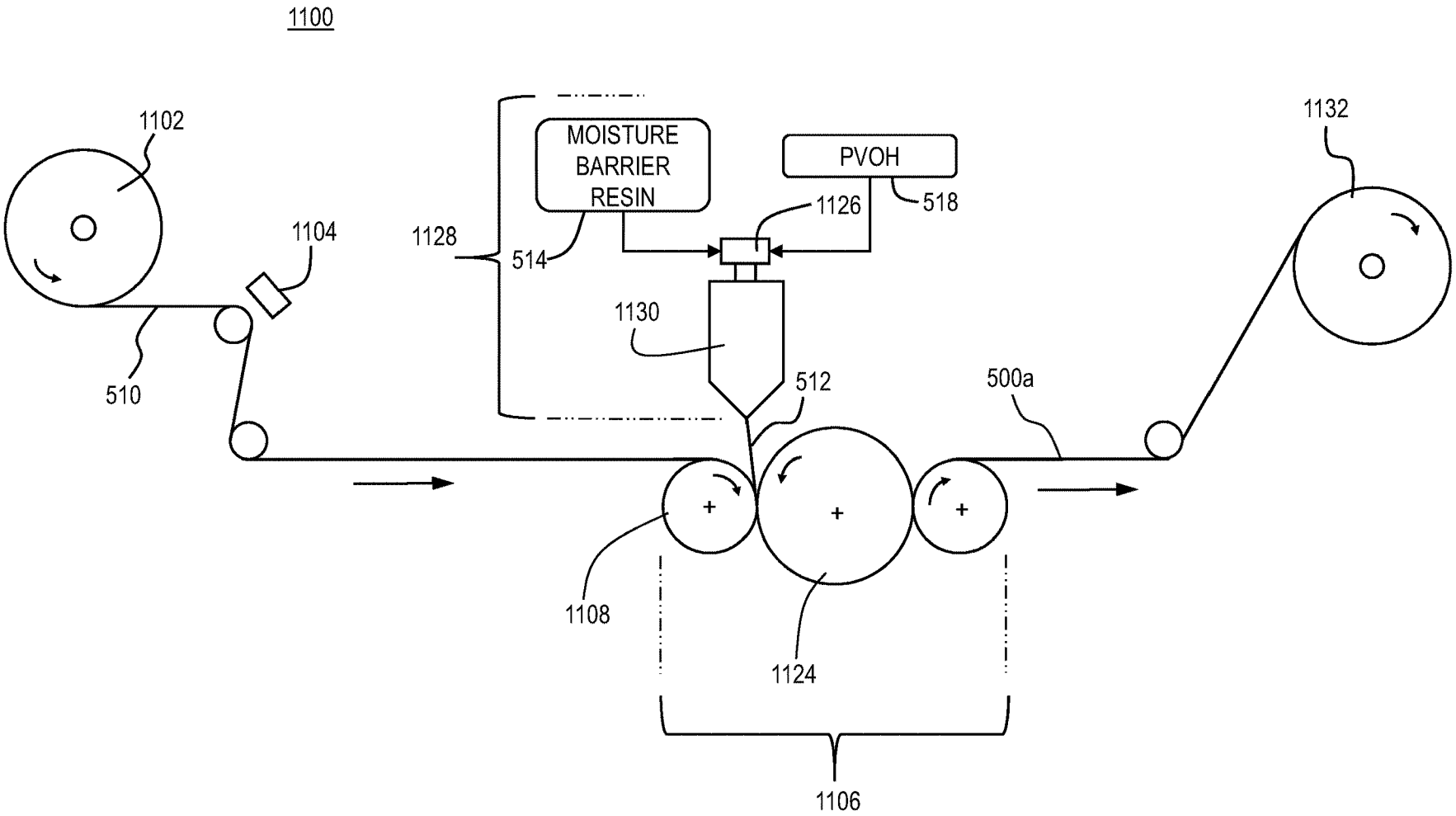
FIG. 11 illustrates an exemplary process line which may be used to make or fabricate the packaging structure appearing in FIG. 5A in a one-step process.

Referring now to FIG. 11, a manufacturing line 1100 for making the packaging is disclosed. The line 1100 illustrated is suitable for making the structures 500*a* described above. Persons skilled in the art will readily appreciate, however, that components of the line 1100 may be eliminated or not used based on the desired structure of the final product.

The line 1100 includes one section which forms a coextrusion laminated substrate including the paper substrate 510 with a coextrusion 512 comprising the inner moisture barrier layer 514 and PVOH layer 518 to form the packaging material 500*a*.

The line 1100 includes a substrate 1102 comprising the paper substrate 510. In embodiments, the paper substrate 510 is preprinted with the ink layer 520 and any associated overprint layer(s). An optional moisture-resistant layer 521 may also be provided as described above. The substrate 510 is unrolled from the substrate roll 1102 and fed toward a coextrusion coater 1106 which coats the substrate 110 with the moisture barrier resin-PVOH coextrusion 512.

On the way to the coextrusion laminator 1106, the paper substrate 510 from the main substrate roll 1102 is fed past a treater 1104, such as a flame treater, corona treater, plasma treater, or ozone treater that treats the second major surface of the paper substrate 510 from the main substrate roll 1102 such that the moisture barrier resin-PVOH coextrusion 512 created at the coextrusion coater 1106 will adhere well to the substrate 110. Optionally, a liquid primer might also be applied to the second major surface of the paper substrate 510 to treat the surface. Although treatment of the substrate is depicted, it should be appreciated that such treatment is not required and some paper substrate materials may not need treatment prior to application of the moisture barrier resin-PVOH coextrusion 512.

At the coextrusion coater 1106, the substrate 510 is fed through a nip point at which point the moisture barrier resin-PVOH coextrusion 512 is applied onto the substrate 510 as a melt curtain. The nip point occurs between a nip roll 1108 and a chill roll 1124. A feed block 1126 of the coextruder 1128 receives the molten moisture barrier resin 514 and molten PVOH 518. The coextrusion 512 of moisture barrier resin-PVOH is extruded by a die 1130 proximate the nip point such that the moisture barrier resin side contacts the paper substrate 510 and is cooled by the chill roll 1124 to form the paper/moisture barrier resin-PVOH structure 500*a*. After exiting the coextrusion coater 1106, the packaging material 500*a* is wound up on a product wind-up roll 1132.

In still further embodiments, a further production line and method for preparing the packaging structure 500*a* is contemplated which is as described above by way of reference to FIG. 11, except wherein the inner moisture barrier layer 514 and the PVOH layer 518 are applied as separate monoextrusions.

Figure 12A:
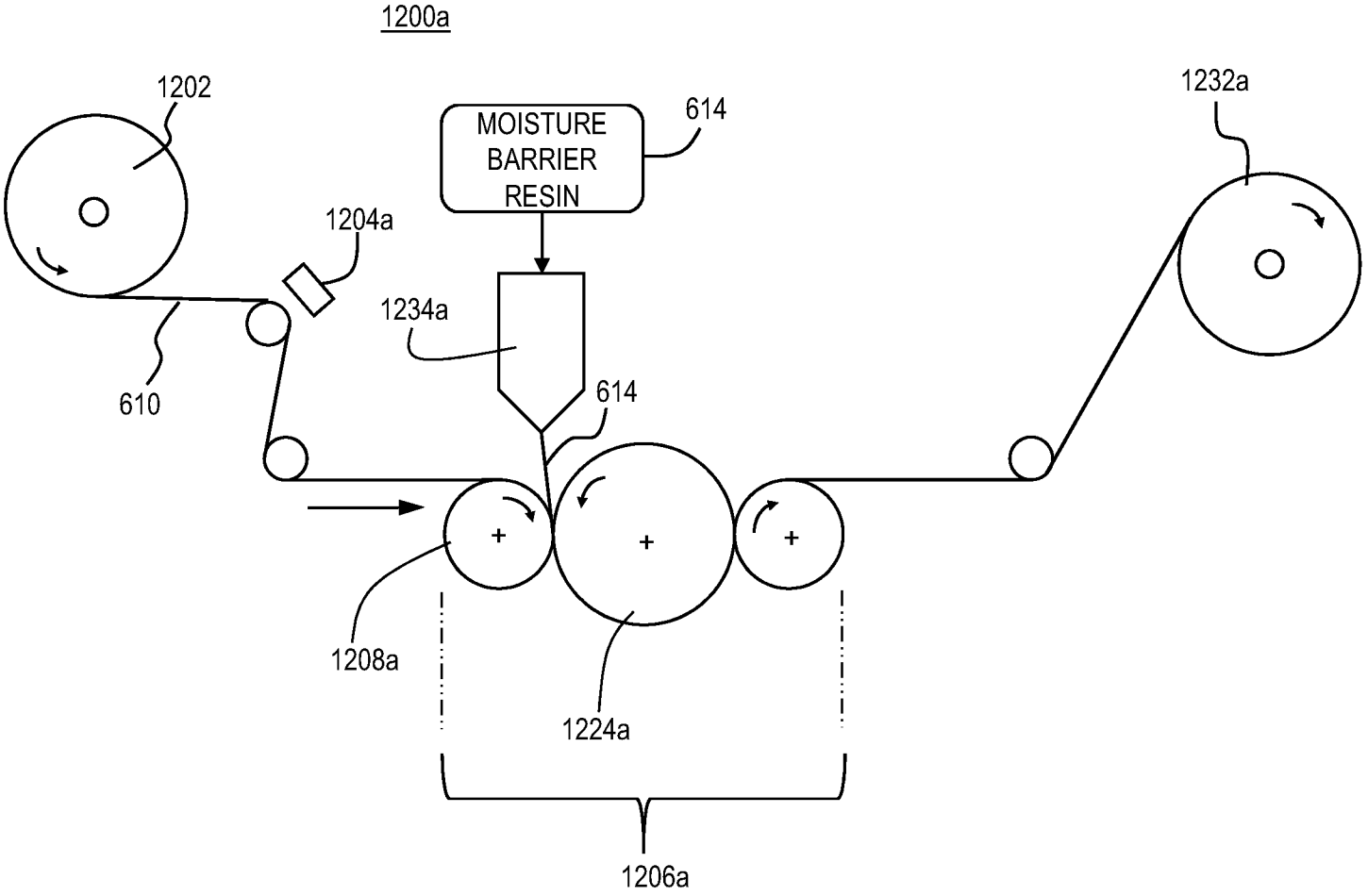
FIGS. 12A and 12B illustrate first and second exemplary process lines which may be used to make or fabricate the packaging structure appearing in FIG. 6 in a two-step process.
Figure 12B:
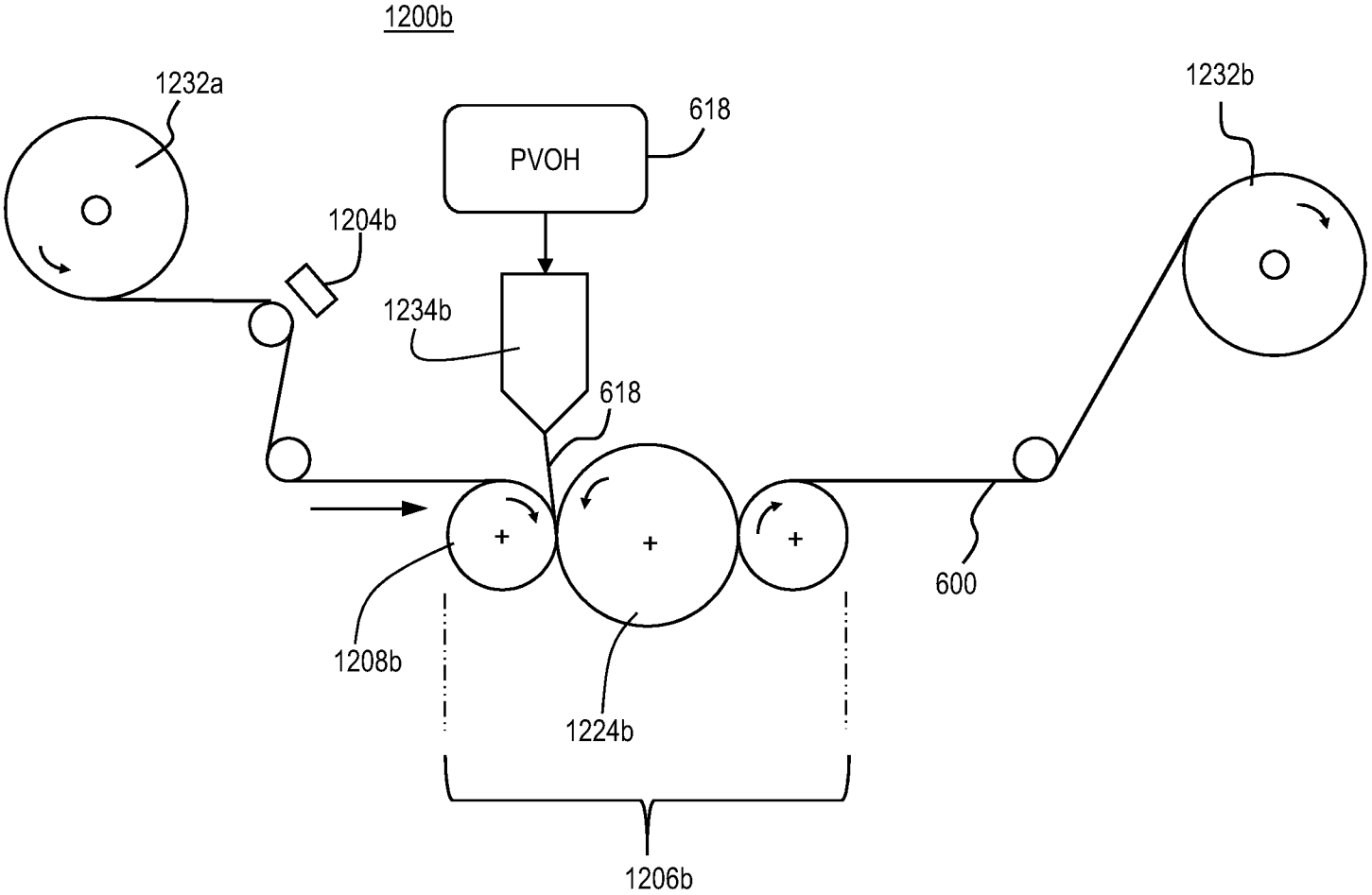

FIGS. 12A and 12B illustrate manufacturing lines 1200*a* and 1200*b* for making the packaging is disclosed. The line 1200*a* illustrated are suitable for making the substrate/moisture barrier resin layer structure as described above. One of ordinary skill in the art will readily appreciate, however, that segments of the line 1200*a* may be eliminated or not used based on the desired structure of the final product.

In the form shown, the line 1200*a* prepares the paper substrate 610. In embodiments, the paper substrate 610 is preprinted with the ink layer 620 and any associated overprint layer(s). An optional moisture-resistant layer 621 may also be provided as described above. The substrate 610 is unrolled from a main substrate roll 1202 and fed toward an extrusion coater 1206*a* which coats the substrate 610 with the moisture barrier resin layer 614.

On the way to the extrusion laminator 1206*a*, the substrate 610 from the main substrate roll 1202 is fed past a treater 1204*a* such as a flame treater, corona treater, plasma treater, or ozone treater, that treats the second major surface of the substrate 610 from the main substrate roll 1202 such that the moisture barrier resin layer 614 created at the extrusion coater 1206*a* will adhere well to the substrate 610. Although treatment of the substrate is depicted, it should be appreciated that such treatment is not required and some substrate materials 610 may not need treatment prior to application of the moisture barrier resin layer 614.

At the extrusion coater 1206*a*, the substrate 610 is fed through a nip point at which point the moisture barrier resin layer 614 is applied onto the substrate 610 as a melt curtain. The nip point occurs between a nip roll 1208*a* and a chill roll 1224*a*. As the substrate 610 approaches the nip point, at a location above the nip point, a die 1234*a* supplies a molten moisture barrier resin layer 614, which may be, for example, polyethylene or any of the polyolefin or functionalized polyolefin moisture barrier materials listed above, as a melt curtain. This molten moisture barrier resin layer 614 is applied to the second major surface of the substrate 610 at the nip point; is cooled by the chill roll 1224*a* to form a substrate/moisture barrier resin layer structure; and then this coated substrate exits the extrusion coater 1206*a*.

It should be appreciated that while the line 1200*a* is shown as including the extrusion coater 1206*a* for the formation of the substrate/moisture barrier resin layer structure, it is possible that the substrate 610 could be coated with the moisture barrier resin layer 614 using methods other than an extrusion coater. For example, a spray coating of the moisture barrier resin layer 614 could be applied to the paper substrate 610.

In any event, after exiting the extrusion coater 1206*a*, the substrate/moisture barrier resin layer structure is wound up on a product wind-up roll 1232*a* for later processing, as described in FIG. 12B.

Referring now to FIG. 12B, a manufacturing line 1200*b* for making the packaging is disclosed. The line 1200*b* illustrated is suitable for making the structures 600 described above. One of ordinary skill in the art will readily appreciate, however, that segments of the line 1200*b* may be eliminated or not used based on the desired structure of the final product.

In the form shown, the line 1200*b* forms the structure 600. In embodiments, the substrate/moisture barrier resin layer structure as described above is unrolled from the roll 1232*a* and fed toward an extrusion coater 1206*b* which coats the substrate/moisture barrier resin layer with the PVOH layer 618 on the major surface opposite the moisture barrier resin layer 614.

On the way to the extrusion laminator 1206*b*, the substrate/moisture barrier resin layer from the main substrate roll 1232*a* is fed past a treater 1204*a* such as a flame treater, corona treater, plasma treater, or ozone treater, that treats the surface of the substrate/moisture barrier resin layer from the main substrate roll 1232*a* such that the PVOH resin layer 618 created at the extrusion coater 1206*b* will adhere well to the substrate/moisture barrier resin layer. Although treatment of the substrate/moisture barrier resin layer is depicted, it should be appreciated that such treatment is not required and some substrate materials 610 may not need treatment prior to application of the PVOH layer 618.

At the extrusion coater 1206*b*, the substrate/moisture barrier resin layer is fed through a nip point at which point the PVOH layer 618 is applied onto the substrate/moisture barrier resin layer as a melt curtain. The nip point occurs between a nip roll 1208*b* and a chill roll 1224*b*. As the substrate/moisture barrier resin layer approaches the nip point, at a location above the nip point, a die 1234*b* supplies a molten PVOH layer 618. This molten PVOH layer 618 is applied to the surface of the substrate/moisture barrier resin at the nip point; is cooled by the chill roll 1224*b* to form the structure 600; and then this coated substrate exits the extrusion coater 1206*b*.

It should be appreciated that while the line 1200*b* is shown as including the extrusion coater 1206*b* for the formation of the structure 600, it is possible that the substrate/moisture barrier resin layer structure could be coated with the PVOH layer 618 using methods other than an extrusion coater. For example, a spray coating of the PVOH layer 618 could be applied to the substrate/moisture barrier resin layer structure.

In any event, after exiting the extrusion coater 1206*b*, the structure 600 is wound up on a product wind-up roll 1232*b*.

Figure 13:
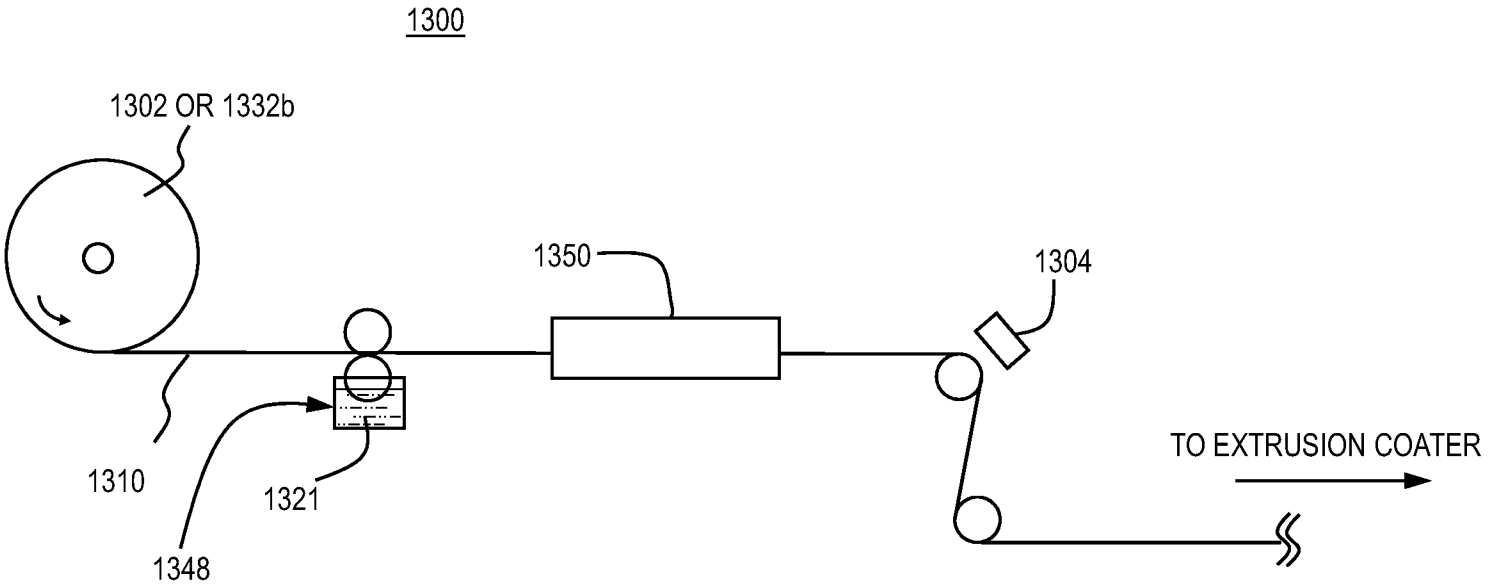
FIG. 13 illustrates an exemplary process line which may be used to provide an optional moisture-resistant coating on a printed or outward surface of the packaging structures herein.

Referring now to FIG. 13, there is shown a partial production line 1300 for providing an outer moisture barrier 1321 on the outer surface, i.e., on the printed ink surface of a substrate 1310. The substrate 1310 is unrolled from a main roll 1302 (or alternately roll 1332*b*) and fed toward a wet process coater 1348 which coats the printed outer surface of the substrate structure 1310 with the optional moisture-resistant coating 1321. The substrate 1310 includes a paper layer with a printed ink layer disposed on the first (outward facing) major surface and a moisture barrier layer disposed on the second major surface.

At the coater 1348, the optional moisture-resistant coating 1321 is applied to the substrate 1310 using a wet coating process. In embodiments, the primer is applied to the printed ink surface of the substrate 1310 using a roll coating process, a roll-to-roll coating process, e.g., a gravure roll or anilox roll, a flexographic process, or is applied via a slot coater. The coating 1321 is then dried using a heater 1350. The coated substrate the proceeds to a treater 1304, extrusion coater(s), etc., as described above by way of reference to any of FIGS. 7-12B.

Particular aspects of the disclosure are described below in the following sets of interrelated Clauses:

Clause 1. A multilayer packaging material, comprising:

a substrate formed of a cellulosic fiber-based material, the substrate having a first major surface and a second major surface opposite the first major surface;

an oxygen barrier layer formed of a PVOH material attached to the first major surface of the substrate, wherein the oxygen barrier layer is an innermost layer of the multilayer packaging material and further wherein the oxygen barrier layer is heat sealable; and at least one moisture barrier layer attached to the substrate, the moisture barrier layer selected from the group consisting of:

(a) an inner moisture barrier layer attached to the first major surface of the substrate and disposed intermediate the substrate and the oxygen barrier layer; and (b) an outer moisture barrier layer attached to the second major surface of the substrate.

Clause 2. The multilayer packaging material of Clause 1, wherein the at least one moisture barrier layer comprises one or both of:

(a) said inner moisture barrier layer disposed intermediate the substrate and the oxygen barrier layer, wherein the inner moisture barrier layer comprises a polyolefin-based polymer resin, a functionalized polyolefin-based polymer resin, and a dried polymer dispersion; and (b) said outer moisture barrier layer disposed on the second major surface of the substrate, wherein the inner moisture barrier layer comprises a polyolefin-based polymer resin, a functionalized polyolefin-based polymer resin, and a dried polymer dispersion.

Clause 3. The multilayer packaging material of any of the preceding Clauses, wherein the at least one moisture barrier layer comprises one or both of:

(a) said inner moisture barrier layer disposed intermediate the substrate and the oxygen barrier layer, wherein the inner moisture barrier layer comprises a polyolefin-based polymer resin or a functionalized polyolefin-based polymer resin; and (b) said outer moisture barrier layer disposed on the second major surface of the substrate, wherein the inner moisture barrier layer comprises a dried polymer dispersion.

Clause 4. The multilayer packaging material of any of the preceding Clauses, wherein the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

Clause 5. The multilayer packaging material of any of the preceding Clauses, comprising said inner moisture barrier layer and further comprising a tie resin layer between the inner moisture barrier and the oxygen barrier layer.

Clause 6. The multilayer packaging material of Clause 5, wherein:

the oxygen barrier layer, tie resin layer, and inner moisture barrier layer and are layers of a three-layer coextrusion;

the oxygen barrier layer and tie resin layer are layers of a two-layer coextrusion;

the tie resin layer and inner moisture barrier layer are layers of a two-layer coextrusion; or the oxygen barrier layer and inner moisture barrier layer are layers of a two-layer coextrusion.

Clause 7. The multilayer packaging material of Clause 5, wherein the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

Clause 8. The multilayer packaging material of any of the preceding Clauses, wherein the oxygen barrier layer defines a product-contacting surface of the multilayer packaging material and wherein the PVOH material is present in an amount sufficient to render the product-contacting surface of the multilayer packaging material grease resistant.

Clause 9. The multilayer packaging material of any of the preceding Clauses, wherein the inner moisture barrier layer is directly attached to the first major surface of the substrate.

Clause 10. The multilayer packaging material of any of the preceding Clauses, wherein the multilayer packaging material has an oxygen transmission rate (OTR) between about 0.001 cc/100 in2/day and about 1.0 cc/100 in2/day measured at 0% relative humidity and 23° C.

Clause 11. The multilayer packaging material of any of the preceding Clauses, wherein the multilayer packaging material has a water vapor transmission rate (WVTR) between about 0.001 cc/100 in2/day to about 2 cc/100 in2/day measured at 23° C. and 85% relative humidity.

Clause 12. The multilayer packaging material of any of the preceding Clauses, further comprising a primer layer disposed between the inner moisture barrier layer and the oxygen barrier layer.

Clause 13. The multilayer packaging material of any of the preceding Clauses, further comprising a tie resin layer and a primer layer disposed between the inner moisture barrier layer and the oxygen barrier layer.

Clause 14. The multilayer packaging material of any of the preceding Clauses, further comprising a tie resin layer which is directly adjacent to the inner moisture barrier layer and a primer layer which is disposed directly adjacent to the oxygen barrier layer.

Clause 15. The multilayer packaging material of any of the preceding Clauses, wherein the inner moisture barrier layer comprises one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof.

Clause 16. The multilayer packaging material of any of the preceding Clauses, wherein the substrate is selected from the group consisting of a paper substrate and a paperboard substrate.

Clause 17. The multilayer packaging material of any of the preceding Clauses, wherein the substrate has a basis weight in the range of from 20 pounds per 3,000 square feet to 120 pounds per 3,000 square feet.

Clause 18. The multilayer packaging material of any of the preceding Clauses, further comprising a printed ink layer disposed on the second major surface of the substrate.

Clause 19. The multilayer packaging material of any of the preceding Clauses, wherein the oxygen barrier layer is food safe.

Clause 20. The multilayer packaging material of any of the preceding Clauses, wherein the multilayer packaging material is recyclable in a paper recycling process.

Clause 21. The multilayer packaging material of any of the preceding Clauses, wherein the first major surface of the substrate is a treated surface configured to promote adhesion between the inner moisture barrier layer and the substrate.

Clause 22. The multilayer packaging material of Clause 21, wherein the treated surface is selected from the group consisting of a flame treated surface, a corona treated surface, a plasma treated surface, an ozone treated surface, and a liquid primer treated surface.

Clause 23. A packaging article formed of the multilayer packaging material of any of the preceding Clauses.

Clause 24. The packaging article of Clause 23, wherein the packaging article is a bag or a pouch and the oxygen barrier layer is hermetically heat sealed to itself.

Clause 25. A method of making a multilayer packaging material, the method comprising:

providing a substrate formed of a cellulosic fiber-based material, the substrate having a first major surface and a second major surface opposite the first major surface;

attaching an oxygen barrier layer formed of a PVOH material to the first major surface of the substrate, wherein the oxygen barrier layer forms an innermost layer of the multilayer packaging material, and further wherein the oxygen barrier layer is heat sealable; and attaching at least one moisture barrier layer to the substrate, the moisture barrier layer selected from the group consisting of:

(a) an inner moisture barrier layer disposed intermediate the substrate and the oxygen barrier layer; and (b) an outer moisture barrier layer disposed on the second major surface of the substrate.

Clause 26. The method of Clause 25, wherein the inner moisture barrier layer is selected from the group consisting of a polyolefin-based polymer resin, a functionalized polyolefin-based polymer resin, and a dried polymer dispersion and wherein the outer moisture barrier layer is selected from the group consisting of a polyolefin-based polymer resin, a functionalized polyolefin-based polymer resin, and a dried polymer dispersion.

Clause 27. The method of Clause 25 or 26, wherein the inner moisture barrier layer is selected from the group consisting of a polyolefin-based polymer resin and a functionalized polyolefin-based polymer resin, and wherein the outer moisture barrier layer is a dried polymer dispersion.

Clause 28. The method of any of Clauses 25-27, wherein the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

Clause 29. The method of any of Clauses 25-28, further comprising:

providing one or both of a tie resin layer and a primer layer between the inner moisture barrier and the oxygen barrier layer.

Clause 30. The method of any of Clauses 25-29, further comprising coextruding the inner moisture barrier layer, a tie resin layer, and the oxygen barrier layer as a three-layer coextrusion;

coextruding the oxygen barrier layer and tie resin layer as a two-layer coextrusion;

coextruding the inner moisture barrier layer and tie resin layer as a two-layer coextrusion; or coextruding the oxygen barrier layer and inner moisture barrier layer as a two-layer coextrusion.

Clause 31. The method of Clause 30, wherein the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

Clause 32. The method of any of Clauses 25-31, wherein the oxygen barrier layer defines a product-contacting surface of the multilayer packaging material, wherein the PVOH material is present in an amount sufficient to render the product-contacting surface of the multilayer packaging material grease resistant.

Clause 33. The method of any of Clauses 25-32, further comprising attaching the inner moisture barrier layer directly to the first major surface of the substrate;

Clause 34. The method of any of Clauses 25-33, wherein the multilayer packaging material has an oxygen transmission rate (OTR) between about 0.001 cc/100 in2/day and about 1.0 cc/100 in2/day measured at 0% relative humidity and 23° C.

Clause 35. The method of any of Clauses 25-33, wherein the multilayer packaging material has a water vapor transmission rate (WVTR) between about 0.001 cc/100 in2/day to about 2 cc/100 in2/day measured at 23° C. and 85% relative humidity.

Clause 36. The method of any of Clauses 25-35, further comprising providing a tie resin layer directly adjacent to the inner moisture barrier layer and a primer layer directly adjacent to the oxygen barrier layer.

Clause 37. The method of any of Clauses 25-36, wherein the inner moisture barrier layer comprises one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof.

Clause 38. The method of any of Clauses 25-37, wherein the substrate is selected from the group consisting of a paper substrate and a paperboard substrate.

Clause 39. The method of any of Clauses 25-38, wherein the substrate has a basis weight in the range of from 20 pounds per 3,000 square feet to 120 pounds per 3,000 square feet;

Clause 40. The method of any of Clauses 25-39, further comprising providing a printed ink layer on the second major surface of the substrate.

Clause 41. The method of any of Clauses 25-40, wherein the oxygen barrier layer is food safe.

Clause 42. The method of any of Clauses 25-41, wherein the multilayer packaging material is recyclable in a paper recycling process.

Clause 43. The method of any of Clauses 25-42, further comprising treating the first major surface to promote adhesion between the inner moisture barrier layer and the substrate.

Clause 44. The method of any of Clauses 25-43, wherein the treating is selected from the group consisting of a flame treating, corona treating, plasma treating, ozone treating, and liquid primer treating.

Clause 45. A method of packaging a product, comprising:

placing a multilayer packaging material around and in contact with the product, said multilayer packaging material comprising:

a substrate formed of a cellulosic fiber-based material, the substrate having a first major surface and a second major surface opposite the first major surface;

an oxygen barrier layer formed of a PVOH material attached to the first major surface of the substrate, wherein the oxygen barrier layer is an innermost layer of the multilayer packaging material and further wherein the oxygen barrier layer is heat sealable; and at least one moisture barrier layer attached to the substrate, the moisture barrier layer selected from the group consisting of:

(a) an inner moisture barrier layer attached to the first major surface of the substrate and disposed intermediate the substrate and the oxygen barrier layer; and (b) an outer moisture barrier layer attached to the second major surface of the substrate; and bringing a first portion of the oxygen barrier layer into opposing and contacting relation with a second portion of the oxygen barrier layer and heat sealing the first portion of the oxygen barrier layer to the second portion of the oxygen barrier layer to hermetically seal the product within the multilayer packaging material.

Clause 46. The method of Clause 45, wherein the product is a food product.

The description above should not be construed as limiting the scope of the invention, but as merely providing illustrations to some of the presently preferred embodiments of this invention. In light of the above description and examples, various other modifications and variations will now become apparent to those skilled in the art without departing from the spirit and scope of the present invention as defined by the appended claims. Accordingly, the scope of the invention should be determined solely by the appended claims and their legal equivalents.

What is claimed is:

1. A multilayer packaging material, comprising:

a substrate formed of a cellulosic fiber-based material, the substrate having a first major surface and a second major surface opposite the first major surface;

an oxygen barrier layer formed of a PVOH material attached to the first major surface of the substrate, wherein the oxygen barrier layer defines a product-contacting surface of the multilayer packaging material and further wherein the oxygen barrier layer is heat sealable; and at least one moisture barrier layer attached to the substrate, the moisture barrier layer selected from the group consisting of:

(a) an inner moisture barrier layer attached to the first major surface of the substrate and disposed intermediate the substrate and the oxygen barrier layer; and (b) an outer moisture barrier layer attached to the second major surface of the substrate.

2. The multilayer packaging material of claim 1, wherein the at least one moisture barrier layer comprises one or both of:

(a) said inner moisture barrier layer disposed intermediate the substrate and the oxygen barrier layer, wherein the inner moisture barrier layer comprises at least one of a polyolefin-based polymer resin, a functionalized polyolefin-based polymer resin, and a dried polymer dispersion; and (b) said outer moisture barrier layer disposed on the second major surface of the substrate, wherein the inner moisture barrier layer comprises at least one of a polyolefin-based polymer resin, a functionalized polyolefin-based polymer resin, and a dried polymer dispersion.

3. The multilayer packaging material of claim 1, wherein the at least one moisture barrier layer comprises one or both of:

(a) said inner moisture barrier layer disposed intermediate the substrate and the oxygen barrier layer, wherein the inner moisture barrier layer comprises a polyolefin-based polymer resin or a functionalized polyolefin-based polymer resin; and (b) said outer moisture barrier layer disposed on the second major surface of the substrate, wherein the inner moisture barrier layer comprises a dried polymer dispersion.

4. The multilayer packaging material of claim 1, wherein the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

5. The multilayer packaging material of claim 1, further comprising any one or more of:

the oxygen barrier layer comprises PVOH material in an amount sufficient to render the product-contacting surface of the multilayer packaging material grease resistant;

the inner moisture barrier layer is directly attached to the first major surface of the substrate;

the multilayer packaging material has an oxygen transmission rate (OTR) between about 0.001 cc/100 $in^2$/day and about 1.0 cc/100 $in^2$/day measured at 0% relative humidity and 23° C.;

the multilayer packaging material has a water vapor transmission rate (WVTR) between about 0.001 cc/100 $in^2$/day to about 2 cc/100 $in^2$/day measured at 23° C. and 85% relative humidity;

a primer layer disposed between the inner moisture barrier layer and the oxygen barrier layer;

a tie resin layer and a primer layer disposed between the inner moisture barrier layer and the oxygen barrier layer;

a tie resin layer which is directly adjacent to the inner moisture barrier layer and a primer layer which is disposed directly adjacent to the oxygen barrier layer;

the inner moisture barrier layer, the outer moisture barrier layer, or both, each comprise one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof;

the substrate is selected from the group consisting of a paper substrate and a paperboard substrate;

the substrate has a basis weight in the range of from 20 pounds per 3,000 square feet to 120 pounds per 3,000 square feet;

a printed ink layer disposed on the second major surface of the substrate;

the oxygen barrier layer is food safe; and the multilayer packaging material is recyclable in a paper recycling process.

6. The multilayer packaging material of claim 1, comprising said inner moisture barrier layer and further comprising a tie resin layer between the inner moisture barrier and the oxygen barrier layer.

7. The multilayer packaging material of claim 6, wherein:

the oxygen barrier layer, tie resin layer, and inner moisture barrier layer and are layers of a three-layer coextrusion;

the oxygen barrier layer and tie resin layer are layers of a two-layer coextrusion;

the tie resin layer and inner moisture barrier layer are layers of a two-layer coextrusion; or the oxygen barrier layer and inner moisture barrier layer are layers of a two-layer coextrusion.

8. The multilayer packaging material of claim 6, wherein the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

9. The multilayer packaging material of claim 1, wherein the first major surface of the substrate is a treated surface configured to promote adhesion between the inner moisture barrier layer and the substrate.

10. The multilayer packaging material of claim 9, wherein the treated surface is selected from the group consisting of a flame treated surface, a corona treated surface, a plasma treated surface, an ozone treated surface, and a liquid primer treated surface.

11. A packaging article formed of the multilayer packaging material of claim 1.

12. The packaging article of claim 11, wherein the packaging article is a bag or a pouch and the oxygen barrier layer is hermetically heat sealed to itself.

13. A method of making a multilayer packaging material, the method comprising:

providing a substrate formed of a cellulosic fiber-based material, the substrate having a first major surface and a second major surface opposite the first major surface;

attaching an oxygen barrier layer formed of a PVOH material to the first major surface of the substrate, wherein the oxygen barrier layer defines a product-contacting surface of the multilayer packaging material, and further wherein the oxygen barrier layer is heat sealable; and attaching at least one moisture barrier layer to the substrate, the moisture barrier layer selected from the group consisting of:

(a) an inner moisture barrier layer disposed intermediate the substrate and the oxygen barrier layer; and (b) an outer moisture barrier layer disposed on the second major surface of the substrate.

14. The method of claim 13, wherein the inner moisture barrier layer is selected from the group consisting of a polyolefin-based polymer resin, a functionalized polyolefin-based polymer resin, and a dried polymer dispersion and wherein the outer moisture barrier layer is selected from the group consisting of a polyolefin-based polymer resin, a functionalized polyolefin-based polymer resin, and a dried polymer dispersion.

15. The method of claim 13, wherein the inner moisture barrier layer is selected from the group consisting of a polyolefin-based polymer resin and a functionalized polyolefin-based polymer resin, and wherein the outer moisture barrier layer is a dried polymer dispersion.

16. The method of claim 13, wherein the total weight of polymer materials in the multilayer packaging material minus the weight of the oxygen barrier layer in the multilayer packaging material does not exceed 20% by weight of the total weight of the multilayer packaging material minus the weight of the oxygen barrier layer in the multilayer packaging material.

17. The method of claim 13, further comprising:

providing one or both of a tie resin layer and a primer layer between the inner moisture barrier and the oxygen barrier layer.

18. The method of claim 13, further comprising any one or more of:

the oxygen barrier layer defines a product-contacting surface of the multilayer packaging material, wherein the PVOH material is present in an amount sufficient to render the product-contacting surface of the multilayer packaging material grease resistant;

attaching the inner moisture barrier layer directly to the first major surface of the substrate;

the multilayer packaging material has an oxygen transmission rate (OTR) between about 0.001 cc/100 $in^2$/day and about 1.0 cc/100 $in^2$/day measured at 0% relative humidity and 23° C.;

the multilayer packaging material has a water vapor transmission rate (WVTR) between about 0.001 cc/100 $in^2$/day to about 2 cc/100 $in^2$/day measured at 23° C. and 85% relative humidity;

providing a tie resin layer directly adjacent to the inner moisture barrier layer and a primer layer directly adjacent to the oxygen barrier layer;

the inner moisture barrier layer comprises one or more layers, which may be the same or different, selected from the group consisting of polypropylene, high-density polyethylene (HDPE), medium density polyethylene (MDPE), linear medium density polyethylene (LMDPE), low-density polyethylene (LDPE), linear low-density polyethylene (LLDPE), very low-density polyethylene (VLDPE), metallocene linear low-density polyethylene (mLLDPE), polyolefin plastomer (POP), polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins, and any combination thereof;

the substrate is selected from the group consisting of a paper substrate and a paperboard substrate;

the substrate has a basis weight in the range of from 20 pounds per 3,000 square feet to 120 pounds per 3,000 square feet;

providing a printed ink layer on the second major surface of the substrate;

the oxygen barrier layer is food safe; and the multilayer packaging material is recyclable in a paper recycling process.

19. The method of claim 13, further comprising coextruding the inner moisture barrier layer, a tie resin layer, and the oxygen barrier layer as a three-layer coextrusion;

coextruding the oxygen barrier layer and tie resin layer as a two-layer coextrusion;

coextruding the inner moisture barrier layer and tie resin layer as a two-layer coextrusion; or coextruding the oxygen barrier layer and inner moisture barrier layer as a two-layer coextrusion.

20. The method of claim 19, wherein the tie layer is selected from the group consisting of polyethylene grafted maleic anhydrides (PE-g-MA), polypropylene grafted maleic anhydrides (PP-g-MA), polypropylene grafted acrylic acids (PP-g-AA), ethylene-vinyl acetate (EVA) copolymer resins, ethylene-methacrylic acid (EMAA) copolymer resins, ethylene-methyl acrylate (EMA) copolymer resins, ethylene-methyl methacrylate (EMMA) copolymer resins, ethylene-ethyl acrylate (EEA) copolymer resins, ethylene-butyl acrylate (EBA) copolymer resins, and ethylene n-butyl acrylate (EnBA) copolymer resins.

21. The method of claim 13, further comprising treating the first major surface to promote adhesion between the inner moisture barrier layer and the substrate.

22. The method of claim 21, wherein the treating is selected from the group consisting of a flame treating, corona treating, plasma treating, ozone treating, and liquid primer treating.

23. A method of packaging a product, comprising:

placing a multilayer packaging material around and in contact with the product, said multilayer packaging material comprising:

a substrate formed of a cellulosic fiber-based material, the substrate having a first major surface and a second major surface opposite the first major surface;

an oxygen barrier layer formed of a PVOH material attached to the first major surface of the substrate, wherein the oxygen barrier layer is an innermost layer of the multilayer packaging material and further wherein the oxygen barrier layer is heat sealable; and at least one moisture barrier layer attached to the substrate, the moisture barrier layer selected from the group consisting of:

(a) an inner moisture barrier layer attached to the first major surface of the substrate and disposed intermediate the substrate and the oxygen barrier layer; and (b) an outer moisture barrier layer attached to the second major surface of the substrate; and bringing a first portion of the oxygen barrier layer into opposing and contacting relation with a second portion of the oxygen barrier layer and heat sealing the first portion of the oxygen barrier layer to the second portion of the oxygen barrier layer to hermetically seal the product within the multilayer packaging material.

24. The method of claim 23, wherein the product is a food product.

* * * * *